US012329207B1

(12) United States Patent
Shang et al.

(10) Patent No.: US 12,329,207 B1
(45) Date of Patent: Jun. 17, 2025

(54) ATOMIZING DEVICE, ASSEMBLING METHOD THEREOF AND AEROSOL GENERATING DEVICE

(71) Applicant: Shenzhen Woody Vapes Technology Co., Ltd., Guangdong (CN)

(72) Inventors: Jialong Shang, Guangdong (CN); Ying Cheng, Guangdong (CN); Zupeng Hu, Guangdong (CN); Lijun Chen, Guangdong (CN)

(73) Assignee: Shenzhen Woody Vapes Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/884,170

(22) Filed: Sep. 13, 2024

(30) Foreign Application Priority Data

Mar. 7, 2024 (CN) ..... 202410262855.5

(51) Int. Cl.

| | |
|---|---|
| ***A24F 40/10*** | (2020.01) |
| ***A24F 40/42*** | (2020.01) |
| ***A24F 40/46*** | (2020.01) |
| ***A24F 40/485*** | (2020.01) |
| ***A24F 40/70*** | (2020.01) |

(52) U.S. Cl.
CPC ..... *A24F 40/485* (2020.01); *A24F 40/10* (2020.01); *A24F 40/42* (2020.01); *A24F 40/46* (2020.01); *A24F 40/70* (2020.01)

(58) Field of Classification Search
CPC ..... A24F 40/10; A24F 40/485; A24F 40/42; A24F 40/70; A24F 40/46
See application file for complete search history.

(56) References Cited

U.S. PATENT DOCUMENTS

| | | | | |
|---|---|---|---|---|
| 11,006,675 | B2 * | 5/2021 | Ewing | F22B 1/284 |
| 2016/0135505 | A1 | 5/2016 | Li et al. | |
| 2018/0343923 | A1 | 12/2018 | Chen | |

(Continued)

FOREIGN PATENT DOCUMENTS

| | | | | |
|---|---|---|---|---|
| CN | 204317492 | | 5/2015 | |
| CN | 112806615 | | 5/2021 | |
| CN | 116439433 | * | 7/2023 | A24F 40/46 |

OTHER PUBLICATIONS

Patents Act 1977: Combined Search and Examination Report Under Sections 17 and 18(3) Dated Mar. 21, 2025 From the Intellectual Property Office of the United Kingdom of Great Britain Re. Application No. GB2414078.2. (6 Pages).

*Primary Examiner* — Abdullah A Riyami
*Assistant Examiner* — Thang H Nguyen

(57) ABSTRACT

Disclosed are an atomizing device, an assembling method, and an aerosol generating device. The atomizing device includes a liquid storage container, an atomizing assembly, and a base assembly. The liquid storage container includes an outer shell and an atomized liquid guide tube connected to the outer shell, and an atomized liquid outlet is disposed at the connection between the atomized liquid guide tube and the outer shell. The atomizing assembly includes a first end and a second end opposite to each other, the first end is engaged with the atomized liquid guide tube. The base assembly includes a convex structure and a support portion connected to the convex structure. The convex structure is engaged with the second end. The support portion is engaged with an end of the outer shell away from the atomized liquid outlet.

19 Claims, 15 Drawing Sheets

(56) References Cited

U.S. PATENT DOCUMENTS

| | | | | |
|---|---|---|---|---|
| 2019/0297946 | A1* | 10/2019 | Fu | A24F 40/46 |
| 2019/0336708 | A1* | 11/2019 | Zheng | A24F 40/485 |
| 2021/0267278 | A1* | 9/2021 | Liu | A24F 40/485 |
| 2021/0267279 | A1* | 9/2021 | Liu | A24F 40/05 |
| 2021/0274847 | A1* | 9/2021 | Liu | A24F 40/485 |
| 2021/0282456 | A1* | 9/2021 | Liu | B05B 17/0607 |
| 2022/0192271 | A1* | 6/2022 | Wen | A24F 40/90 |

* cited by examiner

ATOMIZING DEVICE, ASSEMBLING METHOD THEREOF AND AEROSOL GENERATING DEVICE

CROSS-REFERENCE TO RELATED APPLICATIONS

This application claims the benefit of priority of Chinese Patent Application No. 202410262855.5, filed on Mar. 7, 2024, the entire disclosures of which is incorporated herein by reference.

TECHNICAL FIELD

The present disclosure relates to the field of atomization, and more particularly, to an atomizing device, an assembling method thereof, and an aerosol generating device.

BACKGROUND

Atomizing devices is a structure of the aerosol generating device that is configured to generate an aerosol, and therefore comprises an atomizing assembly for atomizing the liquid and mixing it with air to generate the aerosol for use. The atomizing assembly of the conventional atomizing device is often directly installed in an atomized liquid guide tube, resulting in high difficulty of the assembling process, low assembling efficiency, and poor consistency. To make the assembling process of the atomizing device more efficient and consistent, there is a need for an atomizing device that is easier to assemble.

SUMMARY

Embodiments of the present disclosure provide an atomizing device, an assembling method thereof, and an aerosol generating device, which can solve a problem of complex assembling process of an existing atomizing device.

According to a first aspect, embodiments of the present disclosure provide an atomizing device comprising:

a liquid storage container comprising an outer shell and an atomized liquid guide tube, wherein the outer shell is connected to the atomized liquid guide tube, and an atomized liquid outlet is disposed at an end of the atomized liquid guide tube close to a connection between the outer shell and the atomized liquid guide tube;

an atomizing assembly comprising a first end and a second end opposite to the first end, wherein the first end of the atomizing assembly is engaged with an end of the atomized liquid guide tube away from the atomized liquid outlet; and a base assembly comprising a convex structure and a support portion connected to the convex structure, wherein the convex structure is engaged with the second end of the atomizing assembly, and an end of the support portion away from the convex structure is engaged with an end of the outer shell away from the atomized liquid outlet.

According to a second aspect, embodiments of the present disclosure also provide an aerosol generating device comprising an atomizing device as described in any one of the above and a host.

According to a third aspect, embodiments of the present disclosure also provide a method of assembling an atomizing device, which can be applied to the atomizing device or the aerosol generating device according to any one of the above. The outer shell has a mounting cavity therein, the outer shell further has a cup opening and a mounting opening communicating with the mounting cavity. The method of assembling the atomizing device comprises:

providing the atomizing assembly and the base assembly;

performing insertion between the atomizing assembly and the atomized liquid guide tube; and performing insertion between the base assembly and the outer shell to seal the outer shell.

According to a fourth aspect, embodiments of the present disclosure also provide another method of assembling an atomizing device, which can be applied to the atomizing device or the aerosol generating device of any one of the above. The atomizing assembly includes an atomizing tube, a liquid guide member, and a heat generating device. The heat generating device is disposed within the liquid guide member. The atomizing tube is sleeved on the outer peripheral side of the liquid guide member; The method of assembling the atomizing device includes:

inserting the atomizing tube into an end of the atomized liquid guide tube away from the atomized liquid outlet to form a first assembly, and providing the base assembly and inserting the liquid guide member into the base assembly to form a second assembly; and inserting the second assembly into the first assembly from the cup opening in the axial direction of the atomizing tube to complete the assembling of the atomizing device.

BRIEF DESCRIPTION OF THE DRAWINGS

In order to illustrate the embodiments of the present disclosure, the accompanying drawings involving in the description of the embodiments are briefly described below. It is apparent that the accompanying drawings in the following description illustrate only some of the embodiments of the present application, and other accompanying drawings can be made from these drawings without creative effort for those skilled in the art.

For a clear understanding of the present disclosure and its advantages, reference will be made to the accompanying drawings. In the following description, like reference numerals refer to like parts.

Figure 1:
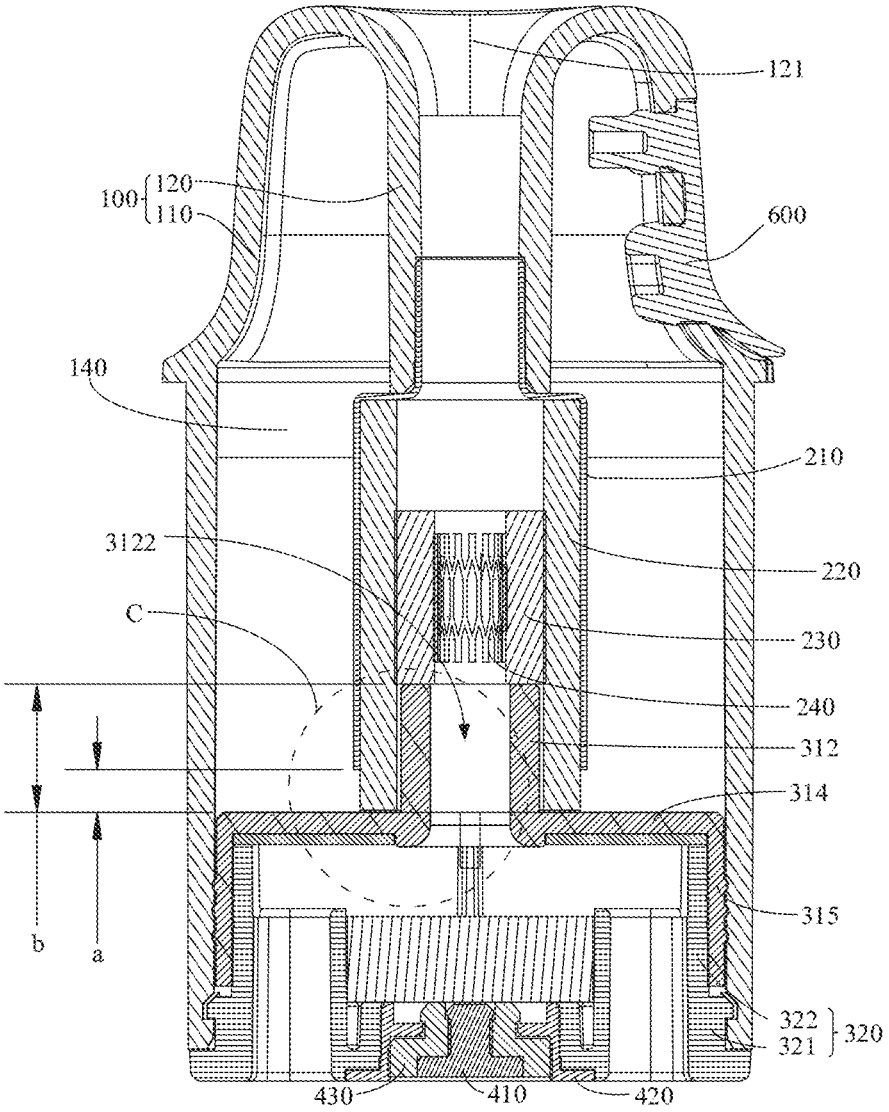
FIG. 1 is a schematic sectional view of a first structure of an atomizing device according to some embodiments of the present disclosure.

List of reference numerals:

| No. | Name | No. | Name |
|---|---|---|---|
| 100 | Liquid storage container | 312a | First wiring channel |
| 110 | Outer shell | 312b | Second wiring channel |
| 120 | Atomized liquid guide tube | 312c | First gap |
| 121 | Atomized liquid outlet | 313 | Heat shield spacer |
| 130 | Mounting cavity | 314 | Support portion |
| 140 | Liquid reservoir | 314a | Gas leakage groove |
| 200 | Atomizing assembly | 315 | First extension portion |
| 210 | Atomizing tube | 315a | Rib |
| 211 | Liquid inlet | 316 | Reinforcing sheet |
| 212 | Abutment portion | 320 | Base |
| 220 | First liquid guide member | 321 | Cover body |
| 230 | Second liquid guide member | 322 | Second extension portion |
| 240 | Heating element | 410 | First electrode |
| 300 | Base assembly | 420 | Second electrode |
| 310 | Seal | 430 | Insulating silica gel |
| 311 | Glue injecting groove | 500 | Liquid absorbing member |
| 312 | Convex structure | 600 | Liquid injection cover |
| 3121 | Liquid collecting ring | 710 | First assembly |
| 3122 | Airflow channel | 720 | Second assembly |

DETAILED DESCRIPTION OF EMBODIMENTS

Embodiments of the present disclosure will be clearly described by reference to the following detailed description of the accompanying drawings. It will be apparent that the described embodiments are only part, rather than all of the embodiments of the present disclosure. Other embodiments made by a person skilled in the art, based on the embodiments in the present disclosure without involving any inventive effort, shall fall within the scope of the present disclosure.

Embodiments of the present disclosure provide an atomizing device, an assembling method thereof, and an aerosol generating device, which can solve a problem of complex assembly of an existing atomizing device. The following description will be made in conjunction with the accompanying drawings.

The atomizing device according to the embodiments of the present disclosure can be applied to an aerosol generating device. The aerosol generating device may include the atomizing device and a host. The host may include various elements such as a control mechanism and a power supply mechanism. When the atomizing device is connected to the host of the aerosol generating device, the power supply mechanism of the host can supply power to the atomizing device, and in turn to an atomizing assembly of the atomizing device, so as to generate heat, in which the specific process of generation of heat is determined by the different types of the atomizing assembly. For example, when the atomizing assembly includes an electric heating wire, an electric current is directly supplied to the atomizing assembly to heat the electric heating wire; and when the atomizing assembly includes a conductor, a variable magnetic field may be provided to the atomizing assembly, so as to excite the atomizing assembly to generate a vortex current for heating. The control mechanism of the host of the aerosol generating device may also include a microphone sensor. When the atomizing device is connected to the host, the microphone sensor can be in communication with an atomized liquid guide tube so that the microphone sensor can detect the gas flow rate in the atomized liquid guide tube and control the power supply mechanism to provide the atomizing assembly with appropriate electric power corresponding to the gas flow rate in the atomized liquid guide tube.

Referring to FIG. 1, some embodiments of the present disclosure provide an atomizing device, which includes a liquid storage container 100, an atomizing assembly 200, and a base assembly 300. The liquid storage container 100 may include an outer shell 110 and an atomized liquid guide tube 120. An atomized liquid outlet 121 is disposed at an end of the atomized liquid guide tube 120. The atomized liquid guide tube 120 is connected with the outer shell at the end close to the atomized liquid outlet 121. The atomizing assembly 200 may include a first end and a second end that are opposite to each other. The first end of the atomizing assembly is engaged with an end of the atomized liquid guide tube 120 away from the atomized liquid outlet 121. The base assembly includes a convex structure 312 and a support portion connected with the convex structure 312. The convex structure 312 is engaged with the second end of the atomizing assembly 200, and an end of the support portion away from the convex structure is engaged with an end of the outer shell away from the atomized liquid outlet 121. A material of the convex structure 312 may include silica gel, rubber, or the like. In some embodiments, an airflow channel 3122 may be provided in the convex structure 312, and it is in communication with the outside to enable the gas path in the atomizing assembly to communicate with the outside.

Figure 13:
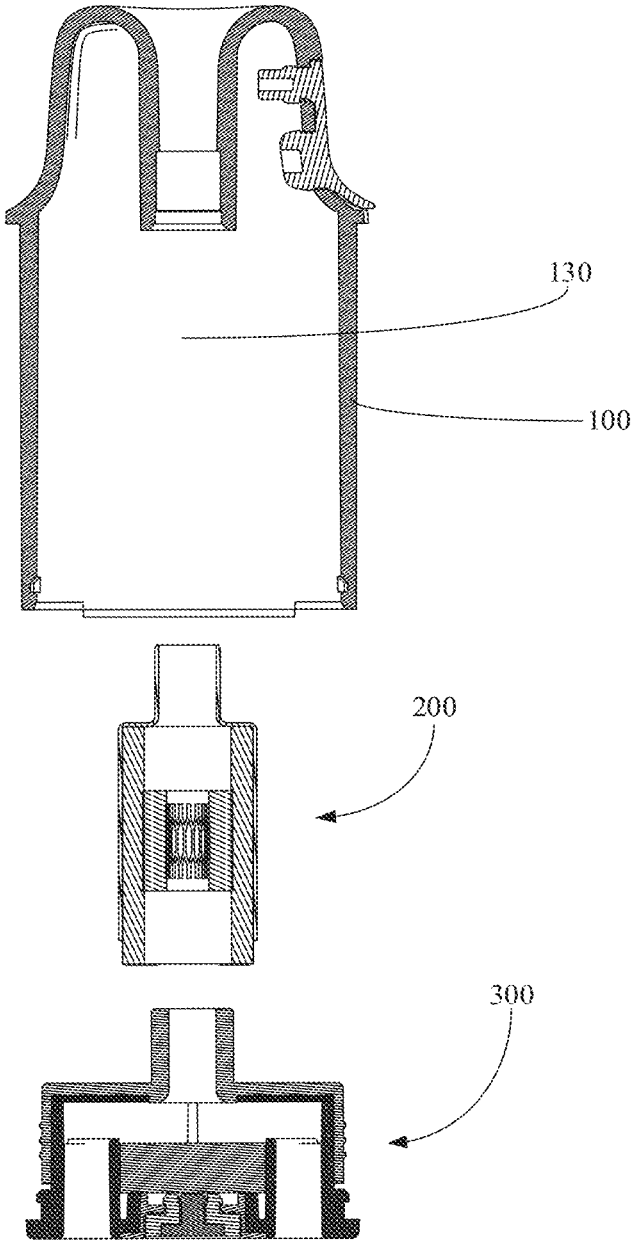
FIG. 13 is a schematic view of the structure of FIG. 1 in a first intermediate state during assembling.

Referring to FIG. 13, in some embodiments, the outer shell 110 provides a mounting cavity 130, and further provides a cup opening and a mounting opening in communication with the mounting cavity 130. The atomized liquid guide tube 120 is disposed in the mounting cavity 130, so that an end of the atomized liquid guide tube 120 is mounted at the mounting opening to form the atomized liquid outlet 121, and the other end extends toward the cup opening. Alternatively, in some embodiments in which the atomized liquid guide tube 120 is not provided, the mounting opening may serve as the atomized liquid outlet 121. As shown in FIG. 1, an edge of the mounting opening is closely joined to an edge of the atomized liquid outlet 121. The atomized liquid guide tube 120 may be integrally formed with the outer shell 110, or can be separately formed and then connected to the outer shell 110 by means of various coupling types, for example, bonding or buckling. The atomizing assembly 200 is connected to the atomized liquid guide tube 120 by insertion connection. For example, the atomizing tube 210 of the atomizing assembly 200 may be inserted into the atomized liquid guide tube 120, as shown in FIG. 1. Alternatively, the atomized liquid guide tube 120 may be inserted into the atomizing tube 210 of the atomizing assembly 200, or into a liquid guide member of the atomizing assembly 200 (not shown). An end of the base assembly 300 close to the atomized liquid guide tube 120 is connected to an end of the atomizing assembly 200 away from the atomized liquid guide tube 120 by insertion connection. For example, the convex structure 312 of the base assembly 300 is inserted into the liquid guide member, as shown in FIG. 1. Alternatively, the atomizing tube 210 of the atomizing assembly 200 is inserted into the base assembly 300 (not shown). The base assembly 300 covers the cup opening to encapsulate the structures within the mounting cavity 130.

At present, the existing atomizing assembly 200 is generally installed in the atomized liquid guide tube 120 in the related art. On the one hand, since the atomized liquid guide tube 120 has a relatively narrow space, it is difficult to install the atomizing assembly 200 inside the atomized liquid guide tube 120 at a predetermined position, resulting in a low assembly efficiency and poor consistency. On the other hand, when the atomizing assembly 200 is installed in the atomized liquid guide tube 120, an end of the atomized liquid guide tube 120 away from the atomized liquid outlet 121 is required to extend to the base assembly 300, so that a longer length of the atomized liquid guide tube 120 is needed. However, if the atomized liquid guide tube 120 has a long length, and a small mounting deviation is present at an end of the atomized liquid guide tube 120 close to the atomized liquid outlet 121, the corresponding mounting deviation will be magnified many times at an end of the atomized liquid guide tube 120 away from the atomized liquid outlet 121. Referring to FIG. 1, the atomizing assembly 200 according to the present disclosure is not installed in the atomized liquid guide tube 120, but only a portion thereof is inserted in the atomized liquid guide tube 120, so that it is possible to eliminate the assembling of the atomizing assembly 200 inside a narrow space of the atomized liquid guide tube 120. Furthermore, the length of the atomized liquid guide tube 120 is shortened, which can make the assembling simpler, even if the atomized liquid guide tube 120 and the outer shell 110 are provided separately. In addition, the atomizing assembly 200, the atomized liquid guide tube 120 and the base assembly 300 are connected to each other by insertion, for example, the atomizing assembly 200 is inserted to the atomized liquid guide tube 120, and then the base assembly 300 is inserted to the atomizing assembly 200 (the assembling of the atomizing device refers to the following description), thereby achieving a high degree of modularity, a convenient assembling and a decreased assembling deviation.

Figure 3:
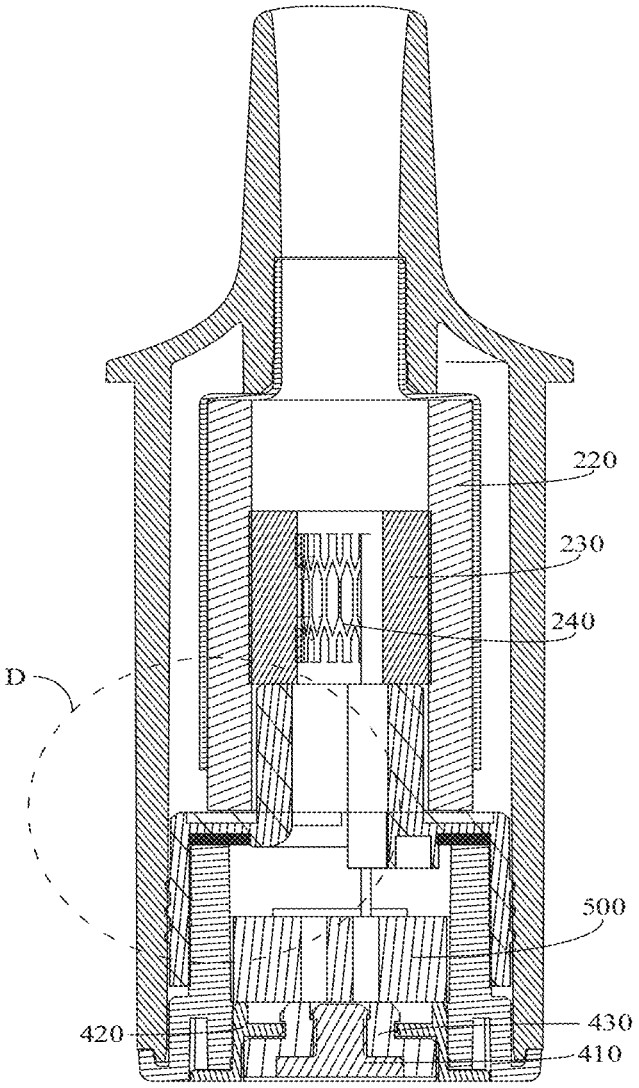
FIG. 3 is a schematic sectional view of the structure of FIG. 1 in another view.
Figure 4:
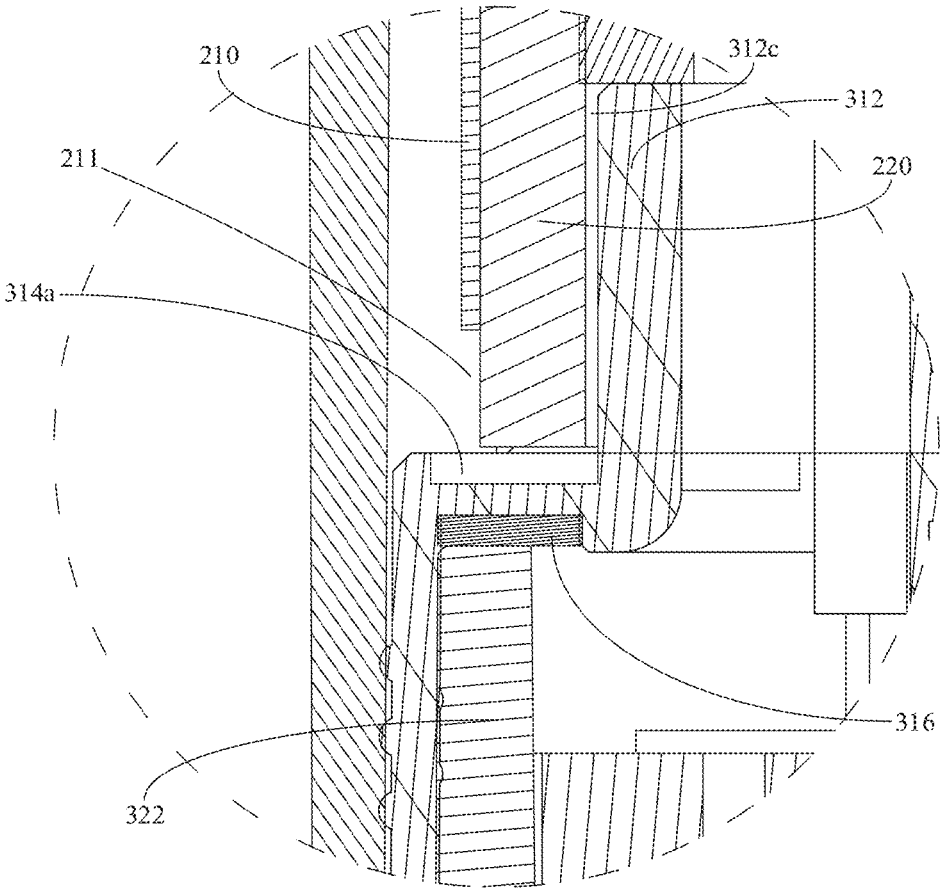
FIG. 4 is an enlarged view of part D in FIG. 3.

Referring to FIG. 1, in some embodiments, the atomizing assembly 200 includes the atomizing tube 210, the liquid guide member, and a heating element 240, and the heating element 240 may be disposed on the inner side of the liquid guide member. The liquid guide member includes a first liquid guide member 220 and a second liquid guide member 230. The heating element 240 may be disposed on the inner peripheral side of the second liquid guide member 230, as shown in FIG. 3. Alternatively, in some embodiments, the heating element 240 may be wrapped by the second liquid guide member 230. Alternatively, in some embodiments, instead of including the second liquid guide member 230, only the first liquid guide member 220 is provided, and the atomizing assembly 200 may be disposed on the inner peripheral side of the first liquid guide member 220 or wrapped by the first liquid guide member 220. The atomizing tube 210 is sleeved on the liquid guide member. The atomizing tube 210 is inserted at an end of the atomized liquid guide tube 120 away from the atomized liquid outlet 121 and communicates with the atomized liquid guide tube 120. An end of the base assembly 300 close to the atomized liquid guide tube 120 is inserted at an end of the liquid guide member away from the atomized liquid guide tube 120 and engaged with an inner peripheral side of the end of the liquid guide member away from the atomized liquid guide tube 120. This arrangement improves the sealing property of the atomizing device and prevents the oil solution from leaking from the liquid reservoir 140 through the atomizing assembly 200. The liquid guide member conducts the oil solution out of the liquid reservoir 140 by capillary action and disperses it throughout the atomizing assembly 200, and the heating element 240 disposed in the liquid guide member comes into contact with the liquid on the liquid guide member, and then heat and atomize the liquid. The atomized liquid is mixed with air to generate an aerosol, which is finally discharged from the atomized liquid outlet 121 for inhale by a user. The distribution of the liquid in the liquid guide member is not uniform, because under the action of gravity the liquid tends to concentrate towards the direction in which the gravity is directed. When the atomizing device is placed upright, that is, the atomized liquid outlet and the support portion are located at the upper and bottom ends, respectively, in the axial direction of the atomizing device, the liquid tends to concentrate towards an end of the liquid guide member close to the support portion. In this case, the liquid concentrated in the position of the liquid guide member close to the support portion may easily escape from the constraint of the liquid guide member and flow out of the liquid guide member. According to the atomizing device of the present disclosure, referring to FIGS. 1 and 13, the base assembly 300 is inserted at an end of the liquid guide member away from the atomized liquid guide tube 120 and engaged with the inner peripheral side of the end of the liquid guide member away from the atomized liquid guide tube 120, thereby preventing the flow of the liquid from the position of the liquid guide member close to the support portion 314, and improving the sealing property of the atomizing device. Referring to FIG. 4, the base assembly 300 is inserted into the atomized liquid guide tube 120 by the convex structure 312, which may be of a tubular shape, or other irregular shapes, which is not limited thereto herein. In addition, it is to be noted that since the atomizing device and the aerosol generating device are often portable in actual use, they are inevitably placed in various orientations including, besides the upright position as shown in FIG. 3, sideway position or even inverted position. When a user uses an atomizing device, the atomizing device is usually placed in an approximately upright position, as shown in FIG. 3, because the user tends to inhale the aerosol with their heads down. During the inhaling of the aerosol, the liquid in the liquid guide member is largely consumed to become an atomized vapor and mixed with air to form the aerosol, and then discharged from the atomized liquid outlet 121. Thus, another liquid is continually replenished from the liquid reservoir 140 to the liquid guide member. In other words, when the atomizing device is used, the flow of the liquid in the liquid guide member becomes the most vigorous, and the liquid is prone to overflow the liquid guide member. In order to improve the sealing effect of the atomizing device, it is sufficient to seal an end of the liquid guide member close to the support portion 314 when the atomizing device is in the upright position as shown in FIG. 3 (i.e., in which the direction of atomized liquid discharge is approximately opposite to the direction of gravity). To this end, the portion of the base assembly 300 inserted into the liquid guide member may be an interference fit or an at least partial clearance fit with the inner peripheral side of the liquid guide member. The sealing effect can be ensured, because the surface tension of the liquid is large, even if there is a clearance fit. The matching mode can be selected according to actual conditions.

Referring to FIG. 1, in some embodiments, the base assembly 300 includes the convex structure 312 and the support portion 314. The convex structure 312 extends towards the atomized liquid guide tube 120 and is configured to be inserted into the liquid guide member. The convex structure 312 may be made from a soft rubber material, such as silica gel or rubber, to improve the sealing effect. Also, the convex structure 312 may be made of a plastic material, a metal material, or other materials capable of sealing, to improve the support property to the atomizing assembly 200 and ensure the sealing effect. The support portion 314 surrounds an end of the convex structure 312 away from the atomized liquid guide tube 120, and a side edge of the support portion 314 away from the convex structure 312 abuts against the inner wall of the liquid storage container 100, so that the liquid storage container 100 together with the atomized liquid guide tube 120 and the atomizing tube 210 forms the liquid reservoir 140. The support portion 314 may also be made of a soft rubber material like the convex structure 312, so as to improve the sealing effect of the liquid reservoir 140 and prevent the liquid from leaking out of the liquid reservoir 140 through a gap between the support portion 314 and the inner wall of the liquid storage container 100. In addition, the arrangement in which the support portion 314 surrounds the end of the convex structure 312 away from the atomized liquid guide tube 120 may be considered as one that the convex structure 312 is inserted into the support portion 314. The convex structure 312 and the support portion 314 may be integrally formed, eliminating the gap between the convex structure 312 and the support portion 314 to prevent the liquid in the liquid reservoir 140 from leaking through the gap. Alternatively, in some embodiments, the convex structure 312 and the support portion 314 may also be provided separately, as described below.

Referring to FIG. 1, in some embodiments, the liquid guide member includes the first liquid guide member 220 and the second liquid guide member 230. The first liquid guide member 220 and the second liquid guide member 230 are both of a tubular shape. The material of the first liquid guide member 220 may include fibers or a porous body. The fiber material may include a plant fiber, an animal fiber, a mineral fiber, a synthetic fiber, or other fibers. The material of the first liquid guide member 220 may include cotton, non-woven fabric, glass fiber, porous ceramic, porous metal, or other materials. The material of the second liquid guide member 230 may include fibers or a porous body. The fiber material may include a plant fiber, an animal fiber, a mineral fiber, a synthetic fiber, or other fibers. The material of the second liquid guide member 230 may include cotton, non-woven fabric, glass fiber, porous ceramic, porous metal, or other materials. The atomizing tube 210 is sleeved on the outer peripheral side of the first liquid guide member 220, the first liquid guide member 220 is sleeved on the outer peripheral side of the second liquid guide member 230, and the heating element 240 is disposed in the second liquid guide member 230. In this way, the liquid successively enters the first liquid guide member 220 and the second liquid guide member 230 and then contacts with the heating element 240, so that the travel distance of the liquid is prolonged, and the blocking effect of the liquid guide member on the liquid is increased, reducing the risk of the liquid flowing out of the liquid guide member (particularly the second liquid guide member 230). An end of the base assembly 300 close to the atomized liquid guide tube 120 is inserted into the first liquid guide member 220, and at least partially abuts against the second liquid guide member 230. In this way, when the atomizing device is used, the lower end of the second liquid guide member 230 in the gravity direction can be blocked to prevent the liquid from leaking out of the second liquid guide member 230, thereby improving the sealing effect. Furthermore, the second liquid guide member can be supported to prevent from falling off and deforming, thereby prolonging the service life of the second liquid guide member.

Referring to FIG. 1, in some embodiments, the base assembly 300 further includes a first extension portion 315. An end of the first extension portion 315 is connected to the support portion 314 at a side close to the outer shell 110, and the other end extends in a direction away from the atomized liquid guide tube 120. The outer peripheral side of the first extension portion 315 abuts against the inner wall of the outer shell 110, so that the contact area between the support portion 314 and the inner wall of the liquid storage container 100 is enlarged, and when the liquid enters the gap between the support portion 314 and the liquid storage container 100 and escapes from the support portion 314, the first extension portion 315 can further provide the blocking effect, thereby improving the sealing and avoiding leakage of the liquid.

Figure 2:
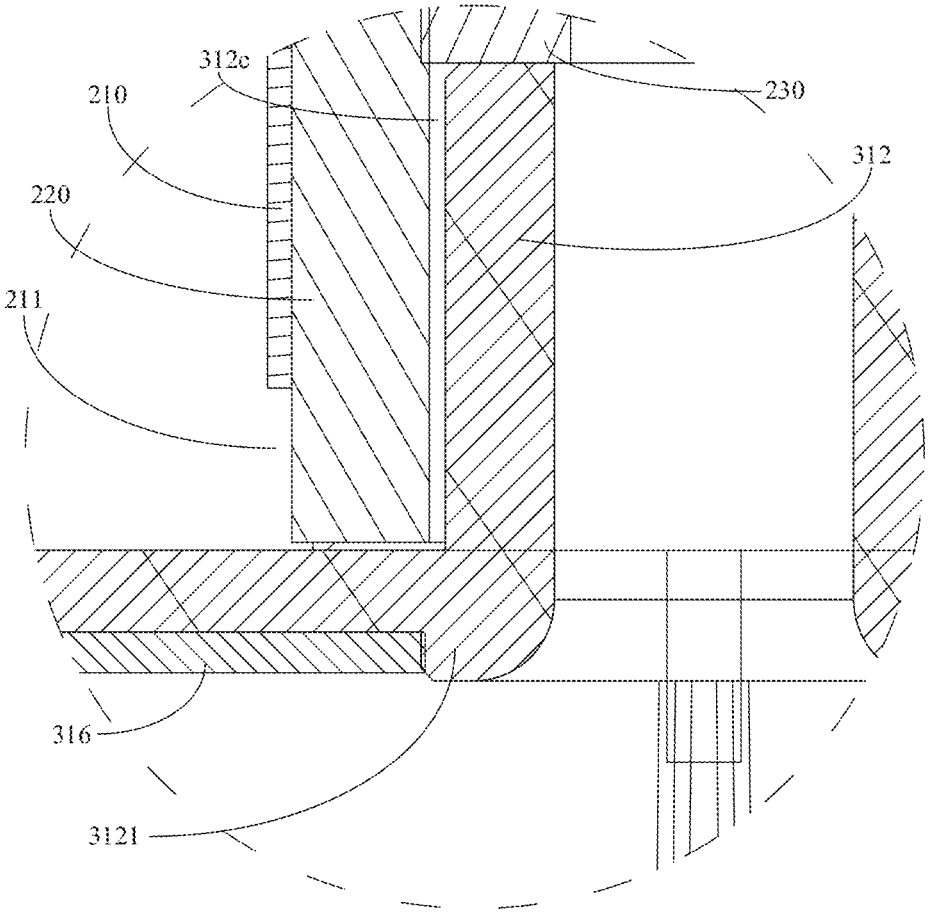
FIG. 2 is an enlarged view of part C in FIG. 1.

Referring to FIG. 2, in some embodiments, the base assembly 300 further includes a reinforcing sheet 316. The reinforcing sheet 316 is attached to a side of the support portion 314 facing away from the liquid reservoir 140 to support the support portion 314. The rigidity of the reinforcing sheet 316 may be greater than that of the support portion 314. For example, the reinforcing sheet 316 may be made of a steel sheet or a hard plastic, and the support portion 314 may be made of a soft rubber material. The support portion 314 can provide a good sealing effect, and the reinforcing sheet 316 may prevent deformation of the support portion 314. Since the deformation of the support portion 314 may result in the support portion 314 not being able to abut against the inner wall of the liquid storage container 100 and cause leakage, the reinforcing sheet 316 can indirectly improves the sealing effect.

Figure 6:
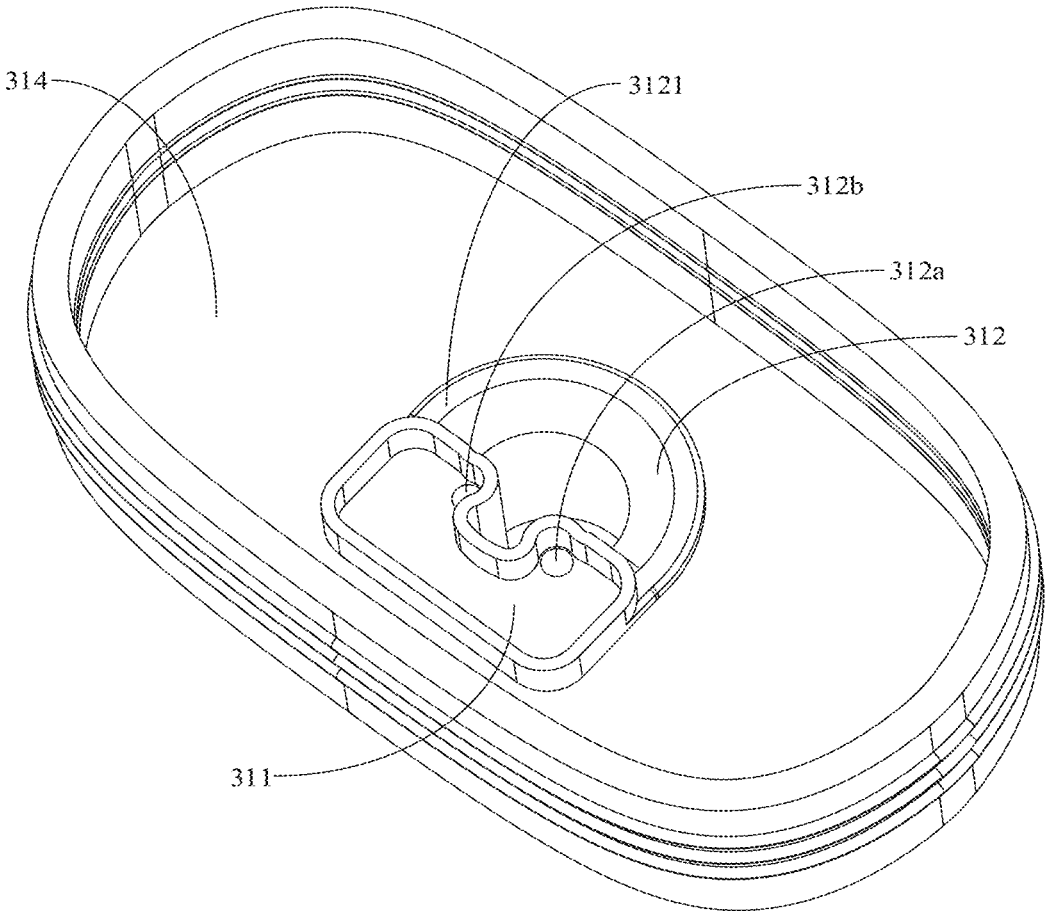
FIG. 6 is a schematic view of the structure of FIG. 5 in another view.
Figure 8:
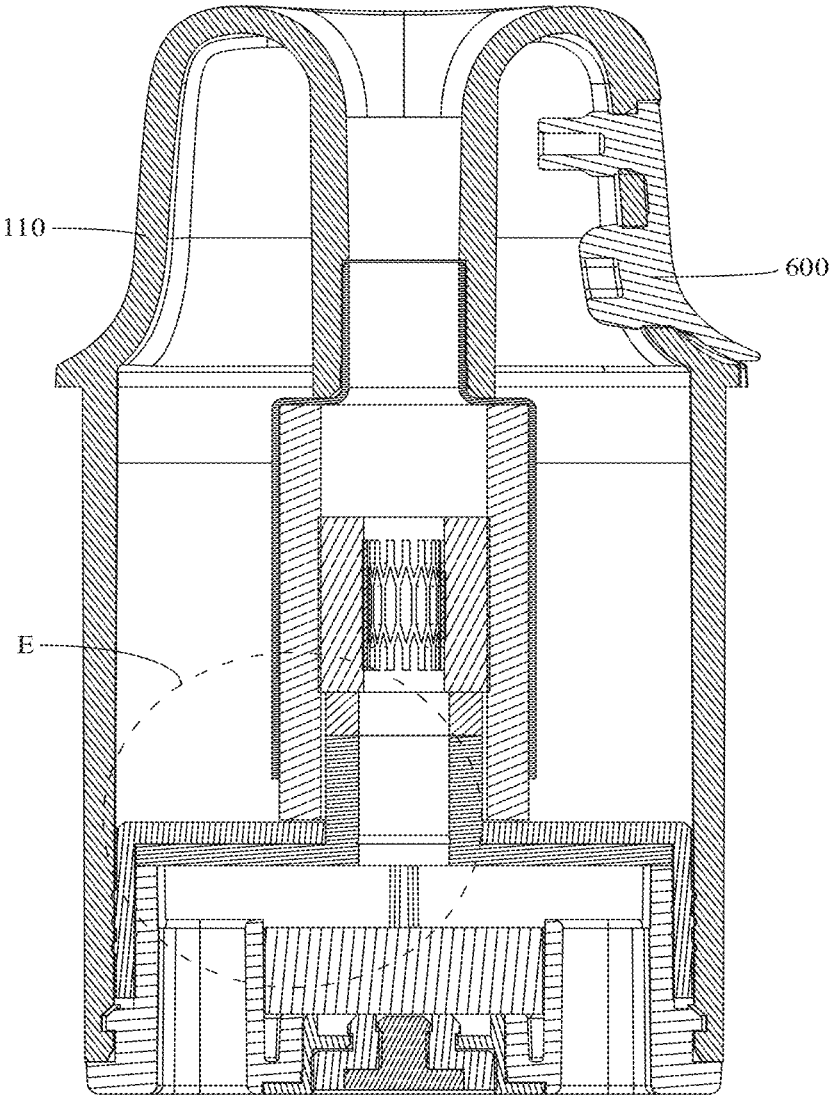
FIG. 8 is a schematic sectional view of a second structure of an atomizing device according to some embodiments of the present disclosure.

Referring to FIGS. 2, 6 and 8, in some embodiments, for example, the reinforcing sheet 316 surrounds an end of the convex structure 312 away from the atomized liquid guide tube 120, and the convex structure 312 protrudes from a side of the reinforcing sheet 316 facing away from the support portion 314, as shown in FIGS. 2 and 6. When the convex structure 312 protrudes from the side of the reinforcing sheet 316 facing away from the support portion 314, a liquid collecting ring 3121 is formed at the end of the convex structure 312 protruding from the reinforcing sheet 316. Referring to FIG. 2, the bottom of the liquid collecting ring 3121 is lower than that of the reinforcing sheet 316. In other words, an end of the liquid collecting ring 3121 facing away from the second liquid guide member 230 is more protruding towards the gravity direction with respect to the reinforcing sheet 316. The liquid collecting ring 3121 can prevent the condensed liquid from flowing into the position where the reinforcing sheet 316 is located, so that the sealing effect is better, and leakage is avoided. In operation of the atomizing device, the condensed liquid droplets may flow along the inner side wall of the convex structure 312 toward the base 320, and eventually converge at the liquid collecting ring 3121, which prevents condensed liquid droplets from flowing to the reinforcing sheet 316 along the lateral direction of the convex structure 312, so that the flow of the condensed liquid droplets is controllable. Specifically, when the condensed liquid droplets reach a certain amount, the droplets will fall down. Since the droplets are gathered at the liquid collecting ring 3121, the droplets may fall down approximatively at a projection of the liquid collecting ring 3121 on the base 320. At the projection position a discharge passage or a structure such as a liquid absorbing member 500 (as described below) may be provided to remove the condensed liquid from the atomizing device or to store it into the liquid absorbing member 500, preventing the condensed liquid from flowing to other devices to cause damage. For example, common damage occurs to the microphone sensor of the aerosol generating device because the condensed liquid may generally flow to the microphone sensor.

Figure 9:
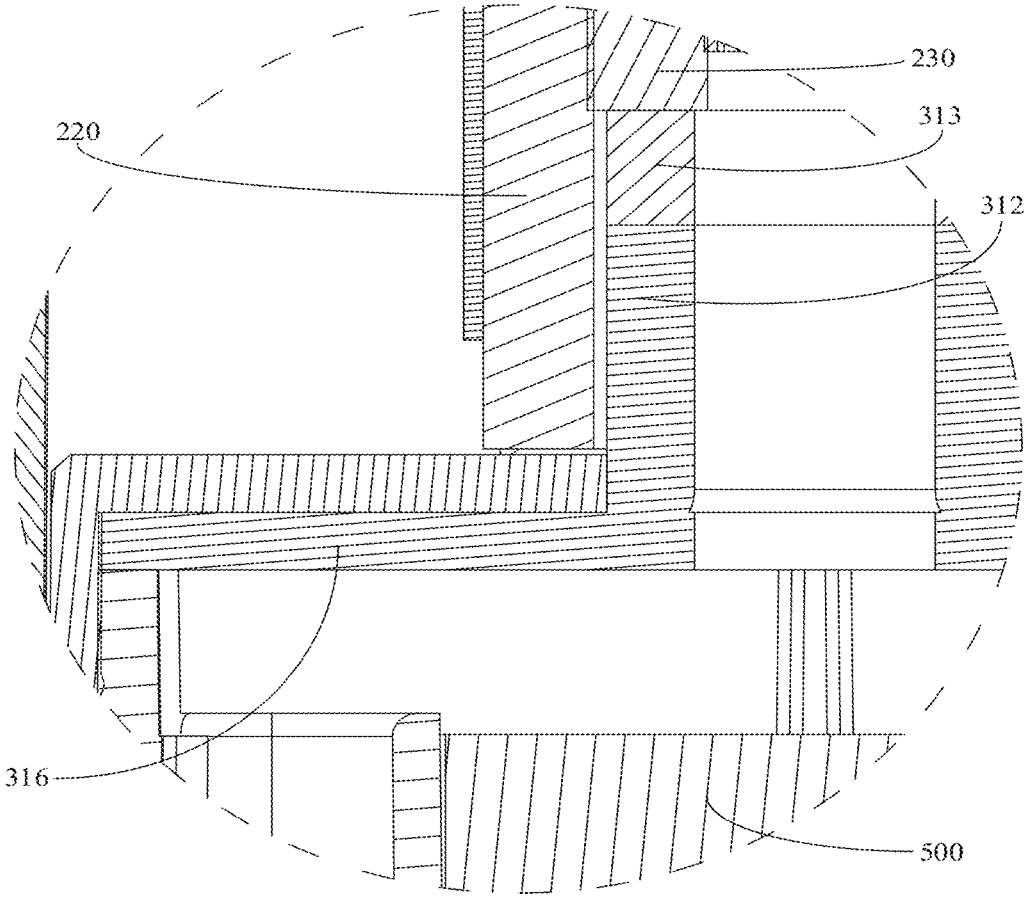
FIG. 9 is an enlarged view of part E in FIG. 8.

Referring to FIG. 8, in some embodiments, the reinforcing sheet 316 surrounds the end of the convex structure 312 away from the atomized liquid guide tube 120 and is integrally formed with the convex structure 312. With further reference to FIG. 9, the convex structure 312 and the reinforcing sheet 316 are integrally formed to provide a stronger support structure, which can fasten an end of the atomizing assembly 200 close to the base 320, and also the support portion 314. In this case, the convex structure 312 and the reinforcing sheet 316 may be made of a hard material such as plastic or metal (including an alloy) to provide a good support effect.

Figure 5:
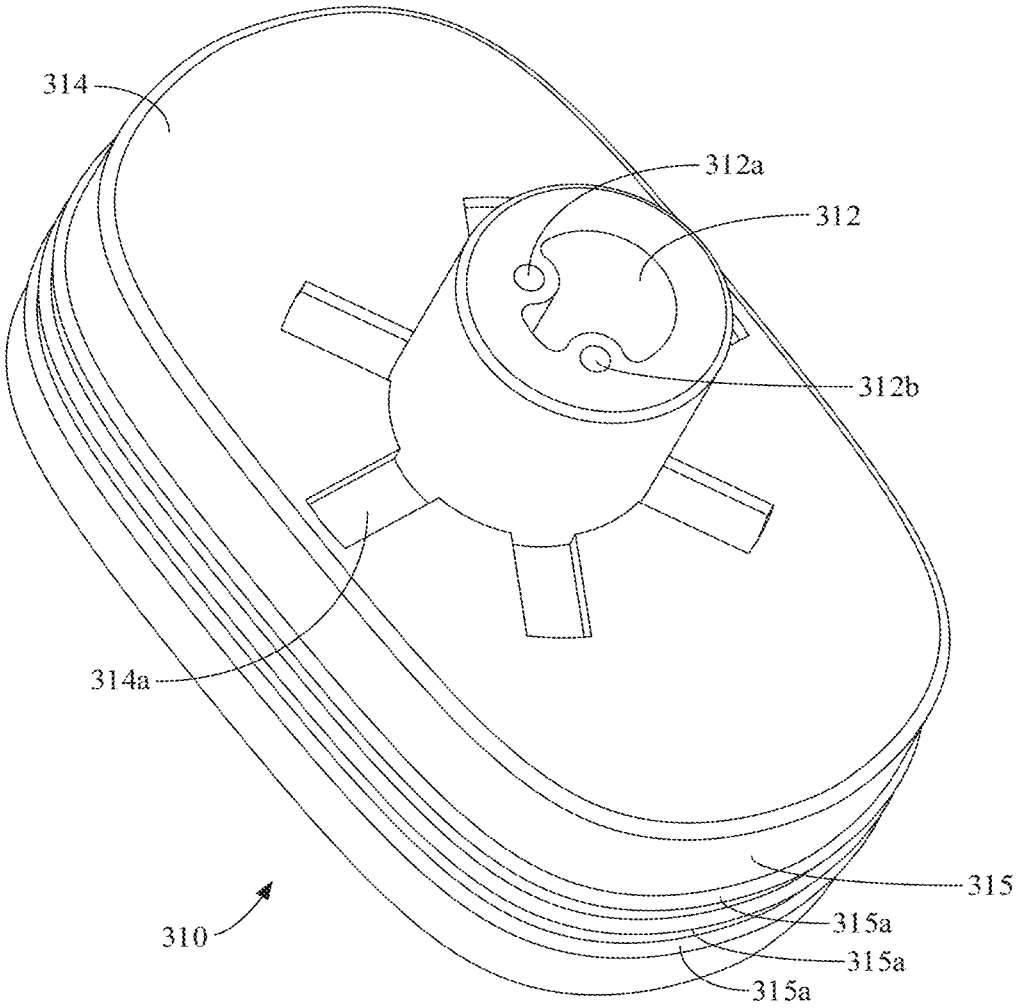
FIG. 5 is a schematic view of a first structure of a seal according to some embodiments of the present disclosure.

Referring to FIGS. 4 and 5, in some embodiments, gas leakage grooves 314*a* are disposed on a side of the support portion 314 facing the liquid reservoir 140. The gas leakage grooves 314*a* extend from the connection between the convex structure 312 and the support portion 314 to the liquid reservoir 140 along the radial direction of the convex structure 312. The gas leakage grooves 314*a* communicates the gap between the convex structure 312 and the liquid guide member with the liquid reservoir 140 to form a gas passage. When the amount of liquid in the liquid reservoir 140 decreases, the gas may be supplied to the liquid reservoir 140 through the gas passage to stabilize the gas pressure, preventing the liquid in the liquid reservoir 140 from not flowing to the heating element 240 due to excessive negative pressure. Reference may be made in particular to the following description of the first gap 312*c*.

Referring to FIG. 2, in some embodiments, the atomizing tube 210 is spaced from the support portion 314, and a fluid inlet 211 is formed at the gap therebetween. The fluid inlet 211 is configured to communicate the liquid guide member with the liquid reservoir 140. Since the support portion 314 is located at the bottom of the liquid reservoir 140, all of the liquid can leave the liquid reservoir 140 through the liquid inlet 211, thereby avoiding waste of residual liquid in the liquid reservoir 140. Also, in some embodiments, as shown in FIG. 1, the heating element 240 is spaced from the liquid inlet 211 in the axial direction of the atomizing tube 210. When the atomizing device is in use, the heating element 240 is higher than the position of the liquid inlet 211, and the liquid needs to run upward within the liquid guide member to the heating element 240 against the action of gravity. This weakens a part of pushing action of the liquid in the liquid reservoir 140 on the liquid in the liquid guide member, and prevents the liquid in the liquid guide member from leaking through the liquid guide member due to excessive pressure. Referring to FIG. 1, the sealing effect is further improved by sealing the inner peripheral side of the liquid guide member in combination with the convex structure 312.

Referring to FIG. 1, in some embodiments, along the axial direction of the atomizing tube 210, the height of the liquid inlet 211 from the support portion 314 is set to be a, the height of the convex structure 312 extending into the liquid guide member is set to be b, and the a and b satisfy $1.5a \leq b \leq 10a$. If $b < 1.5a$, the convex structure 312 may have a poor support effect on the atomizing assembly 200, and the atomizing assembly 200 tends to shake, resulting in leakage of the liquid, and if $b > 10a$, the heating element 240 may be raised too high (because the heating element 240 cannot be obscured by the convex structure 312, but needs to be exposed in an atomizing passage formed by the convex structure 312, the atomizing assembly 200, and the atomized liquid guide tube 120) so that the liquid hardly reaches the heating element 240, causing the heating element 240 to heat up with less liquid and damage to the heating element 240. When b is in the above range, the above problems can be overcome.

Figure 11:
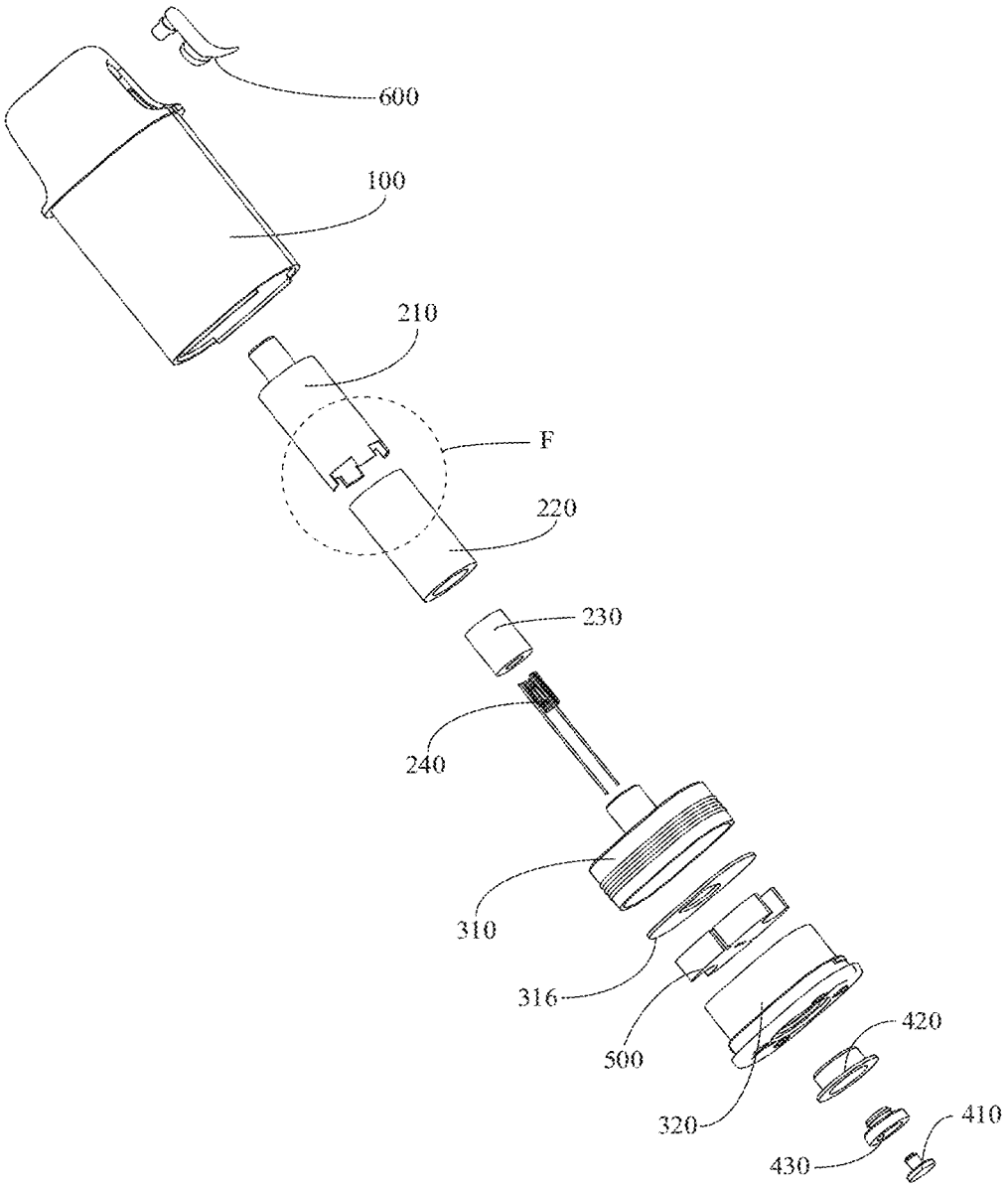
FIG. 11 is a schematic explosive view of the structure of FIG. 1.

Referring to FIGS. 1, 5 and 11, in some embodiments, the atomizing device further includes a first electrode 410 and a second electrode 420. The base assembly 300 includes the base 320 and a seal 310. The base 320 is insertable into the mounting cavity 130 through the cup opening so that the base assembly 300 is connected to the liquid storage container 100 by insertion. The seal 310 includes the convex structure 312 and the support portion 314, and the seal 310 is disposed on the side of the base 320 facing the atomizing assembly 200. The first electrode 410 and the second electrode 420 are spaced apart from each other and run through the base 320. A wiring channel runs through the convex structure 312 along the axial direction of the convex structure 312. The wiring channel may include a first wiring channel 312*a* and a second wiring channel 312*b*. The first electrode 410 may be electrically connected to the heating element 240 through a lead wire in the first wiring channel 312*a*, and the second electrode 420 may be electrically connected to the heating element 240 through a lead wire through the second wiring channel 312*b*. One of the first electrode 410 and the second electrode 420 may be connected to the positive electrode of the heating element 240, and the other may be connected to the negative electrode of the heating element 240. The first electrode 410 and the second electrode 420 are structures by which the atomizing device is electrically connected to the host of the aerosol generating device. Generally, the host includes two contacts (or two pins), which contact the first electrode 410 and the second electrode 420, respectively, when the atomizing device is connected to the host, to achieve electrical connection. In the conventional aerosol generating device, the lead wires disposed on the positive and negative electrodes of the heating element 240 in the atomized liquid outlet channel are easily contacted with each other to cause a short circuit. In the embodiments provided in the present disclosure, the lead wires on the two electrodes of the heating element 240 are disposed in the first wiring channel 312*a* and the second wiring channel 312*b*, respectively, so that the lead wires are spaced apart from each other and it is not easy to generate a short circuit. In addition, referring to FIGS. 1 and 11, the first electrode 410 may be an electrode pin, and the second electrode 420 may be an electrode ring. The electrode pins and the electrode rings may be separated by an insulating silica gel 430 to form separate electrodes. Certainly, the first electrode 410 and the second electrode 420 may be in the form of conventional electrodes as long as the first electrode 410 and the second electrode 420 are spaced apart from each other.

Referring to FIG. 6, in some embodiments, a glue injecting groove 311 is disposed at a side of the seal 310 facing away from the atomizing assembly 200. The first wiring channel 312*a* and the second wiring channel 312*b* both pass through the lower end of the glue injecting groove 311. Since the heating element 240 is provided in the liquid guide member, the first wiring channel 312*a* and the second wiring channel 312*b* are in communication with the liquid guide member, and the liquid may leak along the first wiring channel 312*a* or the second wiring channel 312*b*. Therefore, a sealant may be filled into the glue injecting groove 311 to block a side of the first wiring channel 312*a* and the second wiring channel 312*b* away from the heating element 240 to avoid liquid leakage.

Referring to FIG. 3, in some embodiments, the atomizing device further includes the liquid absorbing member 500. The liquid absorbing member 500 is disposed on a side of the base 320 facing the convex structure 312 and opposite to the convex structure 312. The liquid absorbing member 500 may be made of a material having a strong adsorption capacity for the liquid, for example, a material similar to that of the liquid guide member. In this way, the liquid dripping from the convex structure 312 can be collected into the liquid absorbing member 500, preventing the condensed liquid from flowing to the electronic equipment and damage to the aerosol generating device.

Referring to FIG. 1, in some embodiments, the base assembly 300 includes the seal 310 that includes the convex structure 312. The convex structure 312 is disposed toward the atomizing assembly 200. Referring to FIG. 1, the convex structure 312 is inserted into the atomizing assembly 200 from the end of the atomizing assembly 200 away from the atomized liquid guide tube 120. Alternatively, in other embodiments, the convex structure 312 is sleeved on the outer peripheral side of the atomizing assembly 200. Both arrangements allow the base assembly 300 to be inserted into the end of the atomizing assembly 200 away from the atomized liquid guide tube 120. The former can block the inner peripheral side of the liquid guide member, and the latter can block the gap between the atomizing assembly 200 and the base assembly 300. Both can improve the sealing effect.

Referring to FIGS. 1 and 11, in some embodiments, the atomizing device further includes a liquid injection cover 600. A liquid injection hole is disposed on the outer shell 110 to communicate with the mounting cavity 130 and covered by the liquid injection cover 600. Thus, when the liquid in the liquid reservoir 140 is insufficient, the liquid injection cover 600 can be opened to inject the liquid into the liquid reservoir 140. This allows the atomizing device to be reused. In other embodiments, the atomizing device may be provided without the liquid injection cover 600 as a disposable article.

Figure 15:
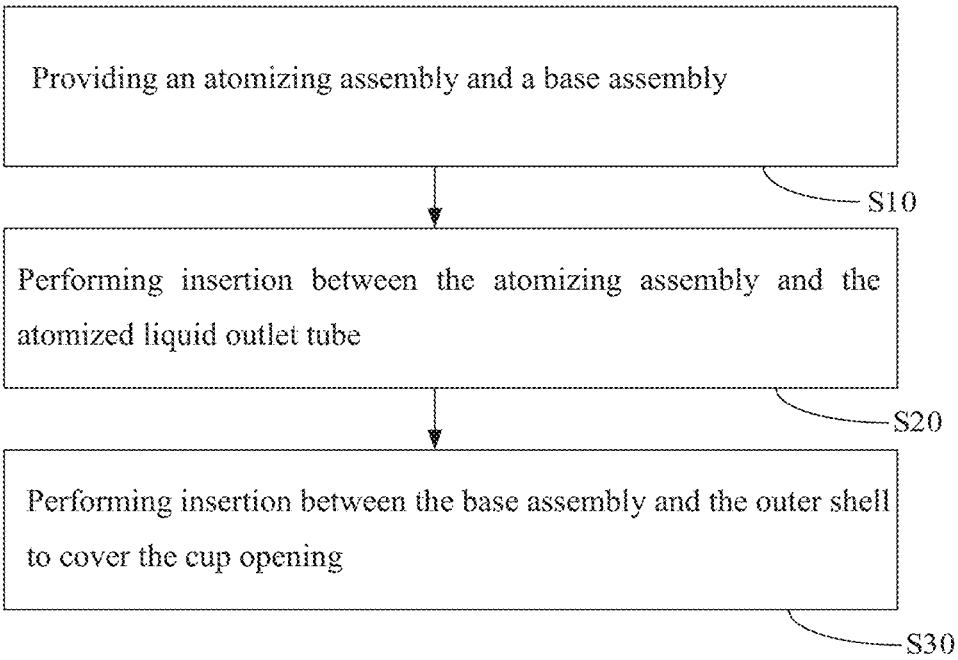
FIG. 15 is a flow chart of a method of assembling an atomizing device according to some embodiments of the present disclosure.

Embodiments of the present disclosure provide a first method of assembling an atomizing device, which can be applied to the atomizing device or aerosol generating device described above. Referring to FIG. 15, the method of assembling the atomizing device includes:

S10. providing the atomizing assembly 200 and the base assembly 300;

S20. performing insertion between the atomizing assembly 200 and the atomized liquid guide tube 120; and S30. performing insertion between the base assembly 300 and the outer shell 110 to cover the cup opening.

When step S10 is completed, the atomizing device is in the state shown in FIG. 13, in which the atomizing device includes three modules, the liquid storage container 100, the atomizing assembly 200, and the base assembly 300. In step S20, the insertion between the atomizing assembly 200 and the atomized liquid guide tube 120 is performed. In step S30, the insertion between the base assembly 300 and the outer shell 110 is performed, and then the insertion between the base assembly 300 and the atomizing assembly 200 is inevitably completed. Therefore, the modular design makes the assembling of the atomizing device convenient.

Embodiments of the present disclosure also provides a second method of assembling the atomizing device, which can be applied to the atomizing device or the aerosol generator described above. In the atomizing device to which the method is applied, the atomizing assembly 200 includes the atomizing tube 210, the liquid guide member, and the heating element 240. The heating element 240 is disposed in the liquid guide member, and the atomizing tube 210 is sleeved on the outer peripheral side of the liquid guide member. The method includes:

S01. inserting the atomizing tube 210 into an end of the atomized liquid guide tube 120 away from the atomized liquid outlet 121 to form a first assembly 710, and assembling the base assembly 300 and inserting the liquid guide member onto the base assembly 300 to form a second assembly 720; and S02. inserting the second assembly 720 from the cup opening in the axial direction of the atomizing tube 210 into the first assembly 710 to complete the assembling of the atomizing device.

Figure 14:
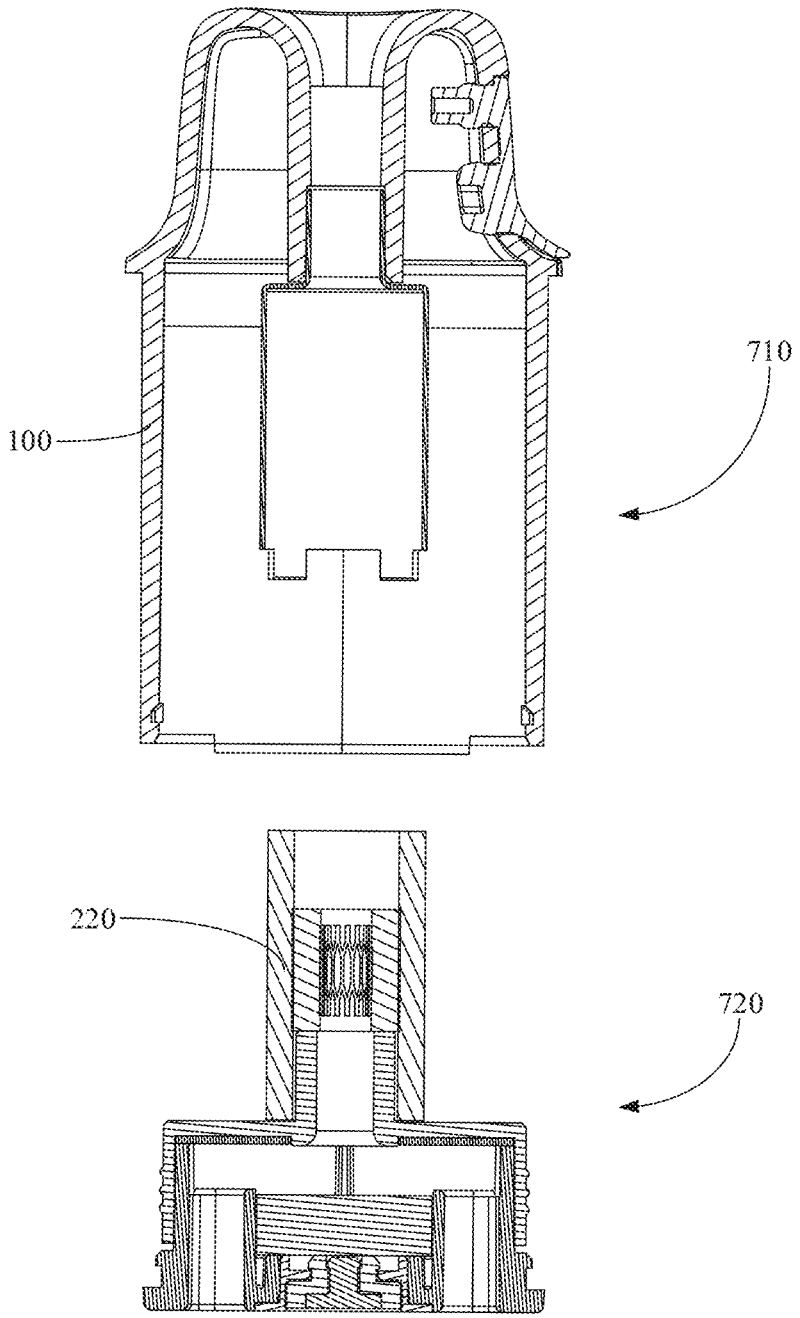
FIG. 14 is a schematic view of the structure of FIG. 1 in a second intermediate state during assembling.

When step S01 is completed, the atomizing device is in the state shown in FIG. 14. After inserting the second assembly 720 into the first assembly 710 from the cup opening (that is, the base assembly 300 is inserted into the liquid storage container 100), the liquid guide member is assembled to the atomizing tube 210, and step S02 is completed to finish the assembling. In other words, the atomizing device may be modularized into the first assembly 710 and the second assembly 720, and the assembling thereof also provides a high degree of modularity and convenience.

Referring to FIG. 1, some embodiments of the present disclosure provides the atomizing device including the liquid storage container 100, the atomizing assembly 200, and the seal 310. The atomized liquid outlet 121 is disposed at an end of the liquid storage container 100. In the embodiments with the atomized liquid guide tube 120, the atomized liquid outlet 121 is provided at an end of the atomized liquid guide tube 120 (referring to FIG. 1). In embodiments without the atomized liquid guide tube 120, the mounting opening on the outer shell 110 may serve as the atomized liquid outlet 121. The atomizing assembly 200 includes the atomizing tube 210, the liquid guide member, and the heating element 240. The heating element 240 is disposed within the liquid guide member, wherein the liquid guide member is configured to conduct fluid to the heating element 240. The atomizing tube 210 is sleeved on the outer peripheral side of the liquid guide member and includes the liquid inlet 211. The atomizing tube 210 communicates with the atomized liquid outlet 121. The seal 310 includes the support portion 314 and the convex structure 312. The support portion 314 abuts against the inner wall of the liquid storage container 100, and forms the liquid reservoir 140 together with the liquid storage container 100 and the atomizing tube 210. The liquid reservoir 140 communicates with the liquid guide member through the liquid inlet 211. The convex structure 312 extends through the support portion 314 into the liquid guide member from the end of the liquid guide member away from the atomized liquid outlet 121, so that the convex structure 312, the atomizing tube 210 and the atomized liquid outlet 121 communicate to form the atomized liquid passage. The convex structure 312 at least partially is engaged with the inner wall of the liquid guide member. A first gap 312*c* is formed at the connection. The first gap 312*c* may be formed by a clearance fit between the liquid guide member and the convex structure 312. An airflow channel may be formed between the liquid guide member and the convex structure 312 even when the liquid guide member and the convex structure 312 abut against each other, because the materials of the liquid guide member and the convex structure 312 are different, so that the absorption capacity of the two to the liquid is different. When the gas passes through the connection between the liquid guide member and the convex structure 312, the liquid is easily detached from the absorption of the liquid guide member or the convex structure 312 under the influence of the gas and a gas channel (the first gap 312*c*) without the liquid is formed in a thin layer of the inner peripheral side of the liquid guide member adhered to the convex structure 312, because the liquid is subjected to different attraction force from the convex structure 312 and the liquid guide member. The liquid guide member is at least partially spaced from the support portion 314 to form a second gap. The first gap 312*c* communicates with the second gap to form a gas inlet passage communicating the atomized liquid passage and the liquid reservoir 140. Referring to FIG. 2, the gas from the gas passage at the middle of the atomizing assembly 200 or the convex structure 312 may be conducted into the liquid reservoir 140 through the gas inlet passage. The reasons for this arrangement is that as the liquid in the liquid reservoir is consumed during use, the space in the liquid reservoir becomes larger. If no new gas is replenished in the liquid reservoir, the volume of original gas in the liquid reservoir may be inflated, resulting in a decreased gas pressure. When the pressure in the liquid reservoir 140 is lower than atmospheric pressure, the liquid may reflow into the liquid reservoir 140, hindering the liquid to be conducted into the heating element 240 by the liquid guide member, so that the heating element 240 may receive insufficient liquid, causing it to overheat and damage to the liquid guide member. Therefore, the first gap 312*c* and the second gap that are in communication with each other enable the gas to be replenished in the liquid reservoir 140 in time, so that negative pressure is avoided, and the liquid supply capacity for the atomizing device is improved.

Referring to FIG. 5, in some embodiments, the liquid guide member abuts the support portion 314. In this way, the support portion 314 can provide support for the liquid guide member and improve the stability of the liquid guide member. The gas leakage grooves 314*a* are disposed on a surface of the support portion 314 facing the liquid guide member to form the second gap. This also ensures the formation of the second gap and the liquid supply capacity of the aerosol generating device.

Referring to FIG. 4, in some embodiments, the gas leakage grooves 314*a* extend radially along the convex structure 312. The gas leakage groove 314*a* protrudes outwardly than the projection of the atomizing tube 210 on the sealing portion along the radial direction of the convex structure 312. As can be seen in FIG. 4, the projection of the convex structure 312 in its axial direction on the support portion 314 does not cover the gas leakage groove 314*a*, which ensures that the length of the gas leakage groove 314*a* is sufficient, so that the gas passage has the sufficient length to ensure that the gas enters the liquid reservoir 140 smoothly.

Figure 7:
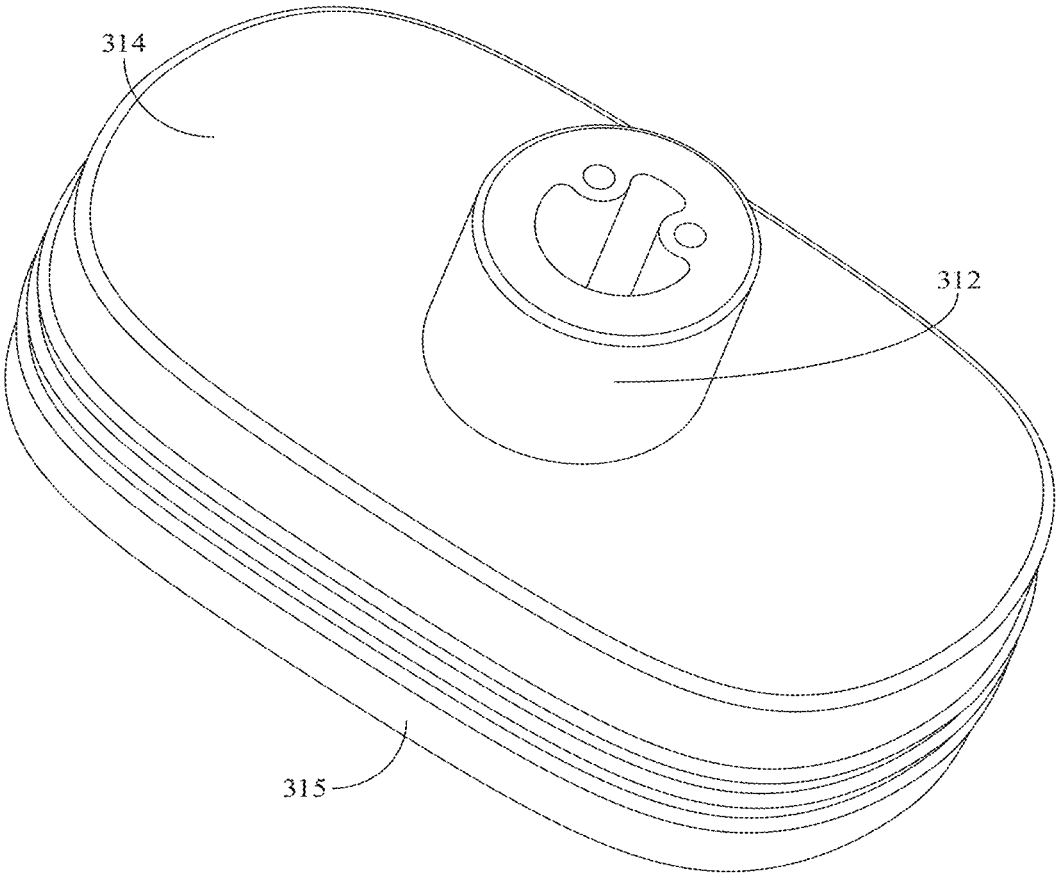
FIG. 7 is a schematic view of a second structure of a seal according to some embodiments of the present disclosure.

Referring to FIG. 5, in some embodiments, a plurality of gas leakage grooves 314*a* are provided, which are equally spaced in the peripheral direction of the convex structure 312, so that it is possible for the user to use the atomizing device at various angles, and the gas leakage grooves 314*a* at various angles can allow gas leakage, thereby ensuring the stability of use of the atomizing device and avoiding poor gas leakage at certain angles. Referring to FIG. 7, in some embodiments, the gas leakage grooves 314*a* may not be provided, but the support portion 314 and the liquid guide member may be spaced apart from each other to form the second gap.

Referring to FIGS. 1 and 2, in some embodiments, the liquid guide member includes the first liquid guide member 220 and the second liquid guide member 230. The atomizing tube 210 is sleeved on the outer peripheral side of the first liquid guide member 220. The first liquid guide member 220 is sleeved on the outer peripheral side of the second liquid guide member 230. The heating element 240 is disposed in the second liquid guide member 230. The radially outer peripheral side of the convex structure 312 is engaged with the radially inner peripheral side of the first liquid guide member 220 to form the first gap 312*c*. A third gap is formed between a surface of the convex structure 312 facing away from the support portion 314 and the second liquid guide member 230. The third gap communicates with the first gap 312*c*. The formation of the first gap 312*c* between the convex structure 312 and the first liquid guide member 220 can refer to the formation the first gap 312*c* between the convex structure 312 and the liquid guide member as described above, details of which are not repeated. The formation principle of the third gap may be the same as that of the first gap 312*c*. Alternatively, a gas groove extending along the radial direction of the second convex structure 312 may be disposed on a surface of the convex structure 312 facing the second liquid guide member 230, and the gas groove communicates with the gas passage in the convex structure 312 and the first gap 312*c* to form the third gap. The arrangement of the third gap may enable the gas passage of the liquid reservoir 140 to provide good gas entering effect.

Referring to FIG. 1, in some embodiments, the seal 310 further includes the first extension portion 315. The first extension portion 315 is provided on the peripheral side of the support portion 314 and extends in a direction away from the liquid reservoir 140. The outer peripheral side of the first extension portion 315 abuts against the inner wall of the liquid storage container 100. In this way, the contact area between the support portion 314 and the inner wall of the liquid storage container 100 is enlarged, so that when the liquid flows to the gap between the support portion 314 and the liquid storage container 100 and escapes from the support portion 314, the first extension portion 315 generates a sealing effect, thereby avoiding leakage of the liquid and improving the sealing effect.

Referring to FIG. 5, in some embodiments, a rib 315*a* is disposed on the outer peripheral side of the first extension portion 315. The rib 315*a* extends along the peripheral direction of the first extension portion 315 and surrounds the first extension portion 315. Thus, when the outer peripheral side of the first extension portion 315 abuts against the inner wall of the liquid storage container 100, the rib 315*a* also abuts against the inner wall of the liquid storage container 100. Since the rib 315*a* protrudes outwardly than the first extension portion 315 in the radial direction of the first extension portion 315, the pressure between the rib 315*a* and the liquid storage container 100 may be greater than the pressure between the other portions of the first extension portion 315 and the liquid storage container 100. This allows the gap between the first extension portion 315 and the cup 100 can be better sealed by the rib 315*a*, thereby improving the sealing effect.

Figure 10:
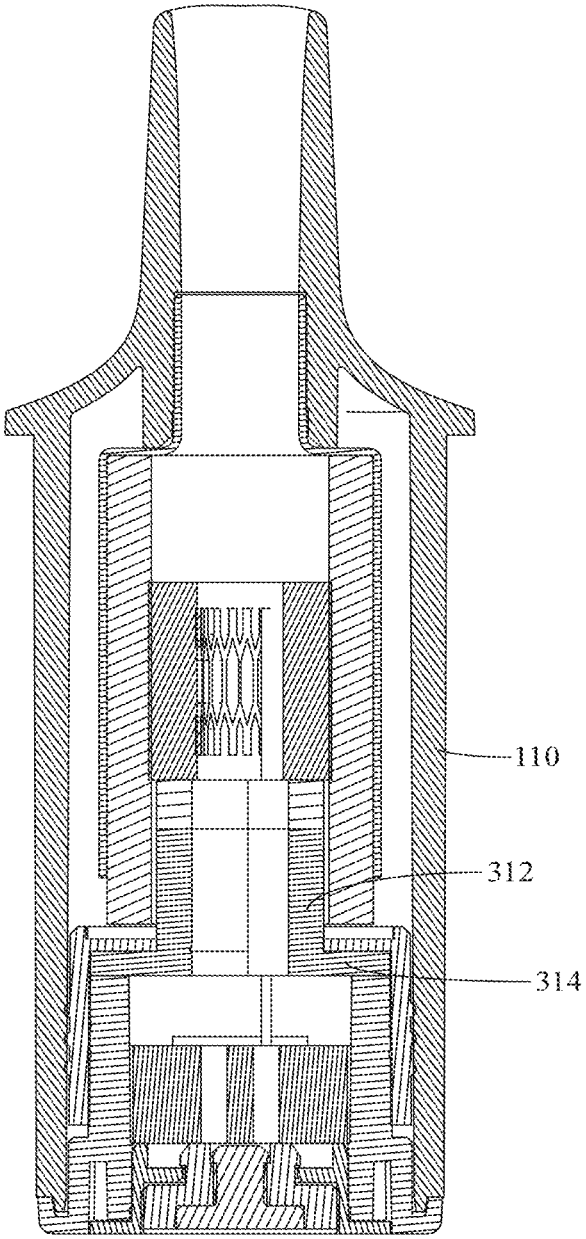
FIG. 10 is a schematic sectional view of the structure of FIG. 8 in another view.

Referring to FIG. 9, in some embodiments, the liquid guide member includes the first liquid guide member 220 and the second liquid guide member 230. The atomizing tube 210 is sleeved on the outer peripheral side of the first liquid guide member 220. The first liquid guide member 220 is sleeved on the outer peripheral side of the second liquid guide member 230. The heating element 240 is disposed in the second liquid guide member 230. The radially outer peripheral side of the convex structure 312 is engaged with the radially inner peripheral side of the first liquid guide member 220 to form the first gap 312*c*. The end of the convex structure 312 facing away from the support portion 314 is engaged with the second liquid guide member 230 to form the third gap. The seal 310 also includes a heat shield spacer 313 that is sleeved at the end of the convex structure 312 close to the second liquid guide member 230. In the embodiments shown in FIG. 8 or FIG. 9, the convex structure 312 and the reinforcing sheet 316 are integrally formed, and thus the convex structure 312 may be made of the same material as that of the reinforcing sheet 316, for example, a plastic having a low heat resistance. In this case, the heat shield spacer 313 may separate the convex structure 312 from the heating element to protect the convex structure 312. Referring to FIG. 10, the heat shield spacer 313 may extend along the axial direction of the convex structure 312 toward the base 320. In this way, the first wiring channel 312*a* and the second wiring channel 312*b* can be provided in the heat shield spacer 313. It will be readily appreciated that, unlike the embodiment shown in FIG. 1, in which no heat shield spacer 313 is provided at the end of the convex structure 312, the embodiment shown in FIG. 9 provides the heat shield spacer 313 at the end of the convex structure 312 close to the second liquid guide member 230.

Referring to FIG. 1 or 11, in some embodiments, the atomizing device further includes the liquid injection cover 600. The liquid injection hole is disposed on the cup wall of the liquid storage container 100. The liquid injection hole is in communication with the liquid reservoir 140 and covered by the liquid injection cover 600. Thus, when the liquid in the liquid reservoir 140 is insufficient, the liquid injection cover 600 can be opened to inject the liquid into the liquid reservoir 140. This allows the atomizing device to be reused.

Referring to FIG. 1, in some embodiments, the liquid injection hole and the second gap are spaced apart in the axial direction of the atomizing assembly 200. In this way, when the liquid is injected, it is difficult for the liquid to flow into the second gap, preventing the liquid from entering the first gap 312*c* and the gas passage in the atomizing assembly 200 through the second gap, and avoiding leakage of the liquid.

Referring to FIG. 1, some embodiments of the present disclosure provides an atomizing device including the liquid storage container 100, the atomizing assembly 200, and the base assembly 300. One end of the liquid storage container 100 is provided with the cup opening, and the other end is provided with the atomized liquid outlet 121. The liquid reservoir 140 is disposed in the liquid storage container 100. The atomizing assembly 200 includes the atomizing tube 210, the liquid guide member, and the heating element 240. The heating element 240 is disposed in the liquid guide member, the atomizing tube 210 communicates with the atomized liquid outlet 121 and is sleeved on the outer peripheral side of the liquid guide member, and the atomizing tube 210 includes the liquid inlet 211 so that the liquid guide member communicates with the liquid reservoir 140. The base assembly 300 includes the base 320 and the seal 310. The cup opening is covered by the base 320. The seal 310 is mounted to the base 320 and extends towards the atomized liquid outlet 121 for insertion at an end of the liquid guide member away from the atomized liquid outlet 121. The seal 310, the atomizing tube 210 and the atomized liquid outlet 121 communicate to form the atomized liquid passage. The seal 310 is engaged with at least a portion of the inner wall of the liquid guide member to block the radially inner side of the liquid guide member. The liquid guide member is guided by capillary action from the liquid reservoir 140 to the heating element 240. The liquid is thus normally filled in the liquid guide member. However, the amount of liquid is not evenly distributed in the liquid guide member. The liquid tends to concentrate towards the direction of gravity. While the atomizing device is generally approximately in the upright position as shown in FIG. 1, the direction of the airflow in the atomized liquid passage is approximately counter-gravity. Thus, the liquid generally be converged in the liquid guide member at the end close to the base 320. Therefore, the seal 310 is engaged with at least a part of the inner wall of the liquid guide member to block the radially inner side surface of the liquid guide member, so that the sealing property can be improved and the liquid leakage can be avoided. In addition, the seal 310 and the inner wall of the liquid guide member may be abutted or spaced. This is due to the fact that the liquid has a large surface tension and, even at intervals, can greatly impede the radial inward flow to the liquid guide member.

Referring to FIG. 1, in some embodiments, the seal 310 includes the convex structure 312 and the support portion 314. The support portion 314 abuts against the inner wall of the liquid storage container 100 to form the liquid reservoir 140 together with the liquid storage container 100 and the atomizing tube 210. One end of the convex structure 312 extends through the support portion 314, and the other end extends towards the atomized liquid outlet 121 so as to be inserted at the end of the liquid guide member away from the atomized liquid outlet 121. The end of the seal 310 facing the base 320 is located in the liquid reservoir 140, and thus there is no leakage without need to be blocked. The support portion 314 also improves the sealing effect of the liquid reservoir 140 and prevents liquid from leaking from the gap between the base assembly 300 and the liquid storage container 100.

Figure 12:
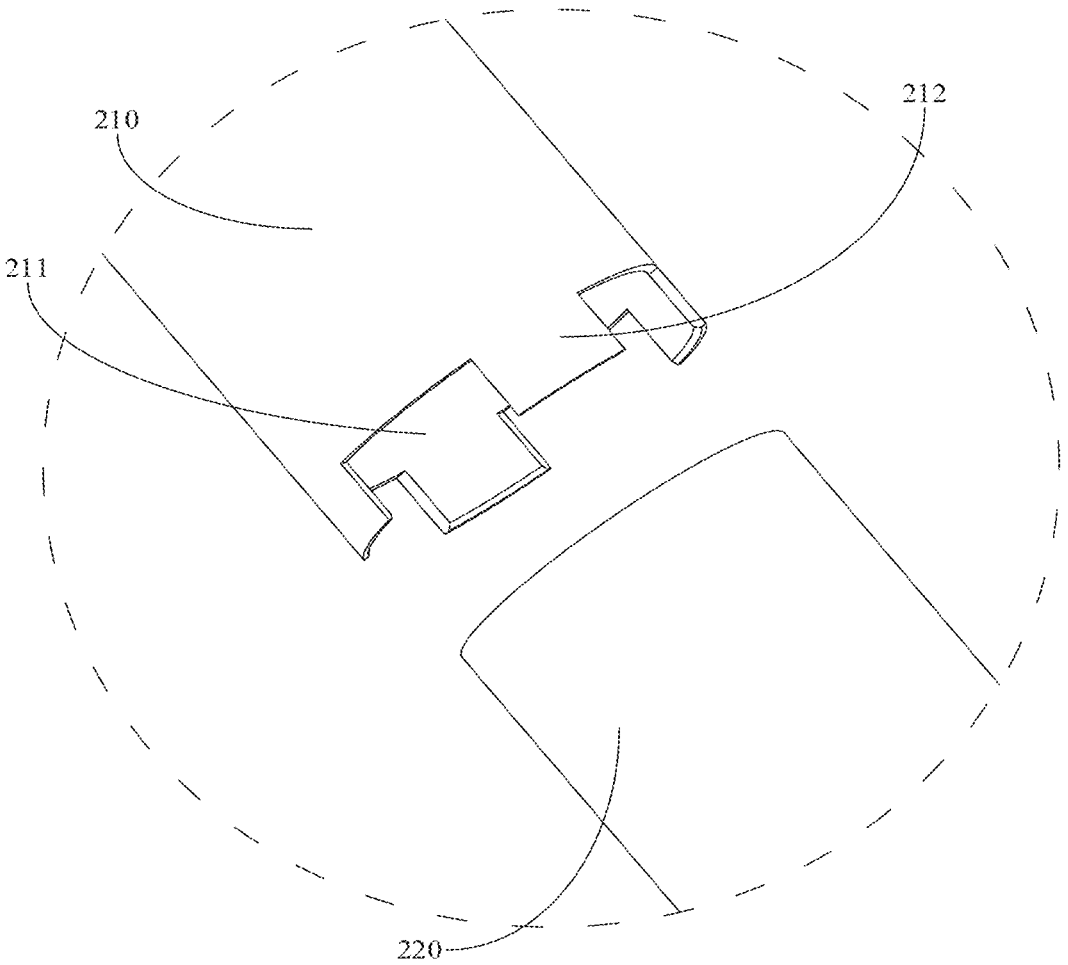
FIG. 12 is an enlarged view of a portion of the atomizing assembly of FIG. 11.

Referring to FIG. 12, in some embodiments, a plurality of abutment portions 212 protruding axially along the atomizing tube 210 are disposed at an end of the atomizing tube 210 close to the support portion 314, and the abutment portions 212 abut the support portion 314. In this way, the support portion 314 can provide support to the end of the atomizing tube 210 close to the support portion 314, thereby improving the fixing effect of the atomizing assembly 200. The plurality of abutment portions 212 are provided at intervals to form a plurality of liquid inlets 211. The plurality of liquid inlets 211 are distributed at equal intervals in the peripheral direction of the atomizing tube 210. Thus, the liquid can enter the liquid guide member in all directions, thereby improving the liquid supply capacity of the aerosol generating device. Referring to FIG. 2, in other embodiments, the end of the atomizing tube 210 close to the support portion 314 is spaced from the support portion 314 to form the liquid inlet 211. This has a simple structure and simplifies the manufacture of the atomizing tube 210. In addition, the length of the liquid inlet 211 in the peripheral direction of the atomizing tube 210 is maximized (i.e., equal to the length of circumference of the atomizing tube 210), so that the liquid can enter the liquid guide member from each direction, thereby improving the liquid supply capacity.

Referring to FIG. 1, in some embodiments, the seal 310 further includes the first extension portion 315. The first extension portion 315 is provided on the peripheral side of the support portion 314 and extends along a direction away from the liquid reservoir 140. The outer peripheral side of the first extension portion 315 abuts against the inner wall of the liquid storage container 100. In this way, when the liquid escapes from the gap between the support portion 314 and the inner wall of the liquid storage container 100, the liquid is blocked by the first extension portion 315, thereby improving the sealing effect of the liquid reservoir 140.

In some embodiments, the convex structure 312 passes through the reinforcing sheet 316 and protrudes towards a side of the reinforcing sheet 316 facing away from the support portion 314. As shown in FIGS. 2 and 6, since the convex structure 312 protrudes towards the side of the reinforcing sheet 316 facing away from the support portion 314, the liquid collecting ring 3121 is formed at the end of the convex structure 312 protruding from the reinforcing sheet 316. During the operation of the atomizing device, the condensed liquid droplets flow along the inner side wall of the convex structure 312 toward the base 320, and are eventually converged in the liquid collecting ring 3121, rather than flowing outwardly in the radial direction of the convex structure 312 to the reinforcing sheet 316, so that the condensed liquid is controllable. Specifically, when the condensed liquid reaches a certain amount, the droplets will drip. Since the droplets are hung on the liquid collecting ring 3121, the droplets may substantially drip at the projection of the liquid collecting ring 3121 on the base 320. A liquid leakage passage or a structure such as the liquid absorbing member 500 mentioned below may be provided to discharge the condensed liquid from the atomizing device or absorb the condensed liquid into the liquid absorbing member 500, so as to prevent the condensed liquid from flowing to other devices to damage. For example, a common danger of condensed liquid is that it will flow to the microphone sensor in the aerosol generating device to damage it.

Referring to FIG. 1, in some embodiments, the base 320 includes a cover body 321 and a second extension portion 322. The cover body 321 is provided at the cup opening of the liquid storage container 100, and the second extension portion 322 is provided at the peripheral side of the cover body 321 and extends toward the support portion 314. The outer peripheral side of the second extension portion 322 abuts against the first extension portion 315, so that the first extension portion 315 can better abut against the inner wall of the liquid storage container 100, thereby improving the sealing effect. The end of the second extension portion 322 away from the cover body 321 may abut against the reinforcing sheet 316 to support it, and thus the fixing effect of the reinforcing sheet 316 can be improved.

Referring to FIG. 4, in some embodiments, the gas leakage groove(s) 314*a* is disposed at the side of the support portion 314 facing the liquid reservoir 140. The gas leakage groove(s) 314*a* extends outwardly from the connection between the convex structure 312 and the support portion 314 along the radial direction of the convex structure 312. The gas leakage groove(s) 314*a* communicates with the liquid reservoir 140. In this way, the gas leakage groove 314*a* can supply gas to the liquid reservoir 140 by means of the second gap between the liquid guide member and the convex structure 312, avoiding that the negative pressure generated by the depletion of the liquid in the liquid reservoir 140 causes the liquid to be unable to be transported to the heating element 240 through the liquid guide member.

Referring to FIG. 1, in some embodiments, the liquid guide member includes the first liquid guide member 220 and the second liquid guide member 230. The atomizing tube 210 is sleeved on the outer peripheral side of the first liquid guide member 220. The first liquid guide member 220 is sleeved on the outer peripheral side of the second liquid guide member 230. The heating element 240 is disposed in the second liquid guide member 230. The radially outer peripheral side of the convex structure 312 abuts against the radially inner peripheral side of the first liquid guide member 220. The end of the convex structure 312 facing away from the support portion 314 abuts against the second liquid guide member 230. In this way, the radially inner side of the first liquid guide member 220 and the end of the second liquid guide member 230 facing the convex structure 312 are blocked, thereby improving the sealing effect to the liquid.

The atomizing device is a part of the aerosol generating device to generate the aerosol. The atomizing assembly included in the atomizing device is used to atomize the liquid and mix with air to generate the aerosol for use. The atomizing assembly of the conventional atomizing device is usually directly installed in the atomized liquid guide tube, and the atomized liquid guide tube is then installed with the liquid storage container by means of bonding or buckling, so that it is difficult for the atomizing assembly to be mounted in place due to the narrow space in the atomizing tube, and the atomized liquid guide tube needs to penetrate through the liquid storage container and then is engaged with the mounting structure on the liquid storage container, resulting in large length to penetrate and difficult assembling. That is, the conventional atomizing device is difficult to install, which makes the assembling of the atomizing device inefficient and poor in consistency. To make the assembling of the atomizing device more efficient and consistent, there is a need for an atomizing device that is more convenient to assemble.

The atomizing device according to the embodiments of the present disclosure has convenient assembling manner, by providing the atomized liquid guide tube in the liquid storage container to engage with the first end of the atomizing assembly to an end of the atomized liquid guide tube away from the atomized liquid outlet, and providing the second end of the atomizing assembly to engage with the convex structure of the base assembly. Specifically, when the atomized liquid guide tube and the outer shell are integrally formed, there is no need to consider the matching between the atomized liquid guide tube and the outer shell when assembling, making the assembling easier. When the atomized liquid guide tube and the outer shell are separately provided, since the atomizing assembly is not arranged in the atomized liquid guide tube, but is engaged with the end of the atomized liquid guide tube away from the atomized liquid outlet, the atomizing tube does not need to extend to the base assembly independently, but extends to the base assembly using the atomizing assembly. Thus, the atomizing tube may have a small length to simplify the assembling. In addition, the atomizing core is connected to the atomized liquid guide tube and the base assembly by insertion, which eliminates the need to rotate the atomizing core (which would normally be required if a threaded connection is used) when the atomizing core is assembled to the atomized liquid guide tube, and it only needs to push the atomizing core toward the atomized liquid guide tube in the insertion direction. Similarly, it is also possible to connect the base assembly by simply pushing it towards the atomizing core in the insertion direction, and the assembly process is more convenient. Therefore, the aerosol generating device according to the embodiments of the present disclosure can have an easily and conveniently assembling.

In the above-mentioned embodiments, the description of each embodiment has its own emphasis, and parts not described in detail in a certain embodiment may be referred to the related description of other embodiments.

In the description of this application, the terms "first" and "second" are used for descriptive purposes only and are not to be interpreted as indicating or implying relative importance or implicitly specifying the number of technical features indicated. Thus, features defined with the terms "first" and "second" may expressly or implicitly include one or more features.

The atomizing device, the assembling method thereof, and the aerosol generating device according to embodiments of the present disclosure have been described in detail. The principles and implementations of the present disclosure have been described with reference to specific examples. The description of the above embodiments is merely provided to assist in understanding the methods and core concepts of the present disclosure. Variations may be made to those skilled in the art in both the detailed implementation and the scope of application in accordance with the teachings of the present disclosure. In summary, the present description should not be construed as limiting the present disclosure.

What is claimed is:

1. An atomizing device comprising:

a liquid storage container comprising an outer shell and an atomized liquid guide tube, wherein the outer shell is connected to the atomized liquid guide tube, and an atomized liquid outlet is disposed at an end of the atomized liquid guide tube close to a connection between the outer shell and the atomized liquid guide tube;

an atomizing assembly comprising a first end and a second end opposite to each other, wherein the first end of the atomizing assembly is engaged with an end of the atomized liquid guide tube away from the atomized liquid outlet; and a base assembly comprising a convex structure, a support portion connected to the convex structure, and a first extension portion, wherein the convex structure is engaged with the second end of the atomizing assembly, an end of the support portion away from the convex structure is engaged with an end of the outer shell away from the atomized liquid outlet, an end of the first extension portion is connected to a side of the support portion close to the outer shell, and another end of the first extension portion extends along a direction away from the atomized liquid guide tube;

wherein an outer peripheral side of the first extension portion abuts against an inner wall of the outer shell.

2. The atomizing device according to claim 1, wherein the atomizing assembly comprises an atomizing tube, a liquid guide member, and a heating element, the heating element is disposed inside the liquid guide member, and the atomizing tube is sleeved on an outer peripheral side of the liquid guide member, and the atomizing tube is inserted in the end of the atomized liquid guide tube away from the atomized liquid outlet to communicate with the atomized liquid guide tube.

3. The atomizing device according to claim 2, wherein an end of the base assembly close to the atomized liquid guide tube is inserted in an end of the liquid guide member away from the atomized liquid guide tube and engaged with an inner peripheral side of the end of the liquid guide member away from the atomized liquid guide tube.

4. The atomizing device according to claim 3, wherein the support portion is disposed to surround an end of the convex structure away from the atomized liquid guide tube.

5. The atomizing device according to claim 3, wherein the liquid guide member comprises a first liquid guide member and a second liquid guide member, both of them are of a tubular shape;

the atomizing tube is sleeved on an outer peripheral side of the first liquid guide member, the first liquid guide member is sleeved on an outer peripheral side of the second liquid guide member, and the heating element is disposed within the second liquid guide member;

an end of the base assembly close to the atomized liquid guide tube is inserted in an end of the first liquid guide member away from the atomized liquid guide tube, and at least partially abuts against the second liquid guide member; and/or a material of the liquid guide member includes fibers or a porous body.

6. The atomizing device according to claim 1, wherein the base assembly further comprises a reinforcing sheet; and the reinforcing sheet is attached to a side of the support portion away from the atomized liquid outlet to support the support portion.

7. The atomizing device according to claim 6, wherein the reinforcing sheet is disposed to surround an end of the convex structure away from the atomized liquid guide tube; and the convex structure is configured to protrude from a side of the reinforcing sheet facing away from the support portion; or the convex structure is integrally formed with the reinforcing sheet.

8. The atomizing device according to claim 4, wherein a gas leakage groove is disposed at a side of the support portion facing the atomized liquid outlet, and the gas leakage groove is configured to extend from a connection between the convex structure and the support portion, to a direction away from the convex structure along a radial direction of the convex structure.

9. The atomizing device according to claim 4, wherein the atomizing tube is spaced from the support portion, and a liquid inlet is disposed between the atomizing tube and the support portion.

10. The atomizing device according to claim 9, wherein, in an axial direction of the atomizing tube, a height of the liquid inlet from the support portion is a; a depth of the convex structure extending into the liquid guide member is b; and a and b satisfy $1.5a \leq b \leq 10a$.

11. The atomizing device according to claim 4, wherein the base assembly comprises a base and a seal, the outer shell is provided with a mounting cavity and comprises a cup opening and a mounting opening, both of them are in communication with the mounting cavity, the base is insertable into the mounting cavity through the cup opening, the seal is disposed on a side of the base facing the atomizing assembly, the seal comprises the convex structure; wiring channels are disposed axially through the convex structure; and a glue injecting groove is disposed on a side of the seal facing away from the atomizing assembly, and the wiring channels pass through a bottom of the glue injecting groove, and the glue injecting groove is filled with a sealant to block the wiring channels.

12. The atomizing device according to claim 11, further comprising a liquid absorbing member, wherein the liquid absorbing member is disposed on a side of the base facing the convex structure and opposite to the convex structure.

13. The atomizing device according to claim 1, wherein the base assembly comprises a seal comprising the convex structure; and the convex structure is disposed toward the atomizing assembly, and the convex structure is insertable into the atomizing assembly from an end of the atomizing assembly away from the atomized liquid guide tube, or the convex structure is sleeved on an outer peripheral side of the atomizing assembly, so that the base assembly is connected to the atomizing assembly by insertion.

14. The atomizing device according to claim 1, wherein the convex structure further comprises an airflow channel communicating with the outside.

15. The atomizing device according to claim 1, further comprising a liquid injection cover; wherein the outer shell comprises a liquid injection hole communicated with an inside of the liquid storage container, and the liquid injection hole is covered by the liquid injection cover.

16. An aerosol generating device comprising an atomizing device and a host, wherein the atomizing device comprises:

a liquid storage container comprising an outer shell and a atomized liquid guide tube, wherein the outer shell is connected to the atomized liquid guide tube, and an atomized liquid outlet is disposed at an end of the atomized liquid guide tube close to a connection between the outer shell and the atomized liquid guide tube;

an atomizing assembly comprising a first end and a second end opposite to the first end, wherein the first end of the atomizing assembly is engaged with an end of the atomized liquid guide tube away from the atomized liquid outlet; and a base assembly comprising a convex structure, a support portion connected to the convex structure, and a first extension portion, wherein the convex structure is engaged with the second end of the atomizing assembly, an end of the support portion away from the convex structure is engaged with an end of the outer shell away from the atomized liquid outlet, an end of the first extension portion is connected to a side of the support portion close to the outer shell, and another end of the first extension portion extends along a direction away from the atomized liquid guide tube;

wherein an outer peripheral side of the first extension portion abuts against an inner wall of the outer shell.

17. The aerosol generating device according to claim 16, wherein the atomizing assembly comprises an atomizing tube, a liquid guide member, and a heating element, the heating element is disposed inside the liquid guide member, and the atomizing tube is sleeved on an outer peripheral side of the liquid guide member, and the atomizing tube is inserted in the end of the atomized liquid guide tube away from the atomized liquid outlet to communicate with the atomized liquid guide tube.

18. The aerosol generating device according to claim 17, wherein an end of the base assembly close to the atomized liquid guide tube is inserted in an end of the liquid guide member away from the atomized liquid guide tube and engaged with an inner peripheral side of the end of the liquid guide member away from the atomized liquid guide tube.

19. A method of assembling an atomizing device, wherein the atomizing device comprises:

a liquid storage container comprising an outer shell and an atomized liquid guide tube, wherein the outer shell is connected to the atomized liquid guide tube, and an atomized liquid outlet is disposed at an end of the atomized liquid guide tube close to a connection between the outer shell and the atomized liquid guide tube;

an atomizing assembly comprising a first end and a second end opposite to the first end, wherein the first end of the atomizing assembly is engaged with an end of the atomized liquid guide tube away from the atomized liquid outlet; and a base assembly comprising a convex structure, a support portion connected to the convex structure, and a first extension portion, wherein the convex structure is engaged with the second end of the atomizing assembly, an end of the support portion away from the convex structure is engaged with an end of the outer shell away from the atomized liquid outlet, an end of the first extension portion is connected to a side of the support portion close to the outer shell, and another end of the first extension portion extends along a direction away from the atomized liquid guide tube;

wherein an outer peripheral side of the first extension portion abuts against an inner wall of the outer shell, wherein the method comprises:

providing the atomizing assembly and the base assembly;

performing insertion between the atomizing assembly and the atomized liquid guide tube; and performing insertion between the base assembly and the outer shell to seal the outer shell.

* * * * *